US005088714A

United States Patent [19]

Nagasawa et al.

[11] Patent Number: 5,088,714

[45] Date of Patent: Feb. 18, 1992

[54] RECIRCULATING SHEET FEEDER

[75] Inventors: Tamami Nagasawa, Osaka; Kozo Takahashi, Nara, both of Japan

[73] Assignee: Sharp Kabushiki Kaisha, Osaka, Japan

[21] Appl. No.: 585,794

[22] Filed: Sep. 20, 1990

[30] Foreign Application Priority Data

Sep. 21, 1989 [JP] Japan ..... 1-246852
Dec. 29, 1989 [JP] Japan ..... 1-342502

[51] Int. Cl.[5] ..... B65H 5/22
[52] U.S. Cl. ..... 271/3.1; 355/320
[58] Field of Search ..... 271/3.1, 258, 242; 355/320

[56] References Cited

U.S. PATENT DOCUMENTS 4,433,836 2/1984 Kulpa et al. ..... 271/3.1
4,637,598 1/1987 Bouwens et al. ..... 271/3.1
4,639,126 1/1987 Bushaw et al. ..... 271/3.1
4,869,488 9/1989 Hirota et al. ..... 271/3.1
4,934,683 6/1990 Ueda et al. ..... 271/3.1
4,980,729 12/1990 Okamoto ..... 355/320

*Primary Examiner*—H. Grant Skaggs

[57] ABSTRACT

In a recirculating feeder, for example for a copying machine, a stack of sheets is placed on a placing member. A detection protrusion, which is rotatable about an axis extending along the placing member, contacts the underside of the stack. A spring urges the detection protrusion in an upward direction so that a top sheet of the stack comes in contact with a pressing member. As the top sheet of the stack is fed, sheets are returned to the placing member under the detection protrusion to form another stack of sheets. After the detection protrusion has urged the last sheet of a stack upward and this last sheet is fed, the detection protrusion cooperates with a sensor to indicate the feeding of the stack is completed. Thereafter, the detection protrusion can rotate to come in contact with the underside of another stack of sheets and the operation can be repeated.

18 Claims, 20 Drawing Sheets 170
171
172
173
174
175
176
177
178
179
180
181
182
183
184
185
186
187
188
189
190
191
192
193
194
195
196
197
198
199
200
201
202
203
204
205
206
207
208
209
210

FIG. 19
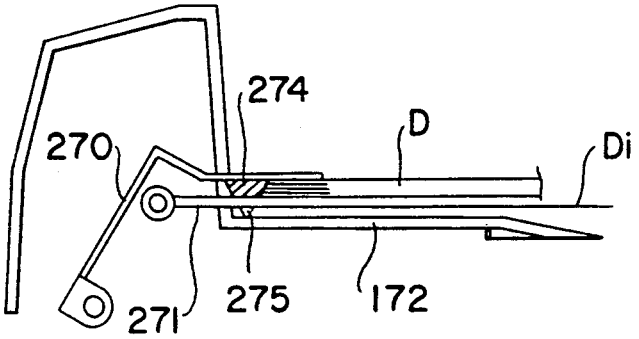
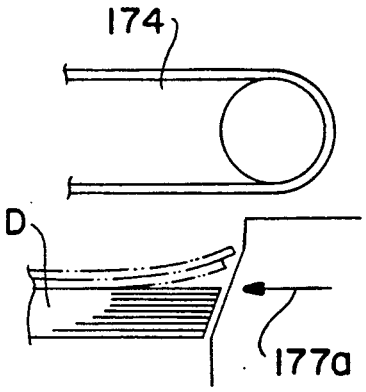
FIG. 20
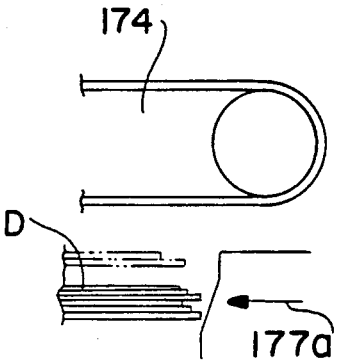
FIG. 21

RECIRCULATING SHEET FEEDER

BACKGROUND OF THE INVENTION

1. Field of the Invention

The present invention relates to a recirculating sheet feeder which is preferably used in, for example, a recirculating document feeder of a copying machine, and capable of feeding a stack of sheets such as a document or the like, seriatim, from top of the stack to a reading station, and returning the sheet to the bottom of the stack, and at the same time, detecting completion of the feeding of the sheets.

2. Description of the Prior Art

In recent years, in an electrostatic copying machine, there is a trend to provide a recirculating document feeder which conveys plural document sheets seriatim to a reading station automatically for optical scanning of the documents, and executes reading and exposing operation of a document image.

The document sheets to be copied are contained in stack in a document container of the document feeder. When the copying operation is started, the document is fed, seriatim automatically from the document container and conveyed to a document transporting path provided with the reading station. In a conventional recirculating document feeder, the document completing a presenting operation of the document image of the reading station is returned to the document container, and received therein separately from the documents which are still not fed. In order to copy one set automatically for plural document sheets, detecting means for detecting the state, wherein all of the document sheets contained in stack in the document container are fed to the document transporting path for the reading and exposing operation is necessitated, toward this end, a detecting device for detecting the aforementioned state is provided.

FIG. 1 is a schematic sectional view showing a first conventional example. The detecting device 1, for detecting completion of feeding the documents, is disposed in the vicinity of a document container 5 in which plural document sheets are contained in stack. The detecting device 1 is constituted by including a detecting unit 2 consisting of a light emitting element and a light receiving element integrated with each other, and an actuating member 4 provided at a portion with a mirror 3 which reflects light from the detecting unit 2. That is the light emitting element of the detecting unit 2 emits light to the actuating member 4 disposed beneath the detecting unit 2 in FIG. 1. This light is reflected by the mirror 3 of the actuating member 4, and when received by the light receiving element of the detecting unit 2, it is detected that all of the documents d were fed.

When the documents d are received in the document container 5 in stack, the actuating member 4 of the detecting device 1 is arranged under the document at the bottom of the documents d contained in stack. When the copying operation is started, from the document container 5, the documents d contained are fed seriatim from the one on top rightward in FIG. 1. When the reading and exposing operation for the document fed is completed, the document taken out is returned to the document container 5 from the under side. At this time, the document being received is returned by inserting the downstream end in the receiving direction underneath the actuating member 4.

When the stack of documents d are fed seriatim from the one on top from the document container 5, and received seriatim in the bottom again in such a way, associated with such feeding and returning operation, the actuating member 4 is gradually pushed upward of the figure. Light emitted downward of the figure from the detecting unit 2 is interrupted by the document d when it is not fed and remained on the actuating member 4. When feeding of the documents d proceeds and the last document is fed, the mirror 3 of the actuating member 4 is exposed against the detecting unit 2, thereby light is reflected to the detecting unit 2 to detect completion of feeding one set of plural document sheets d.

In this first conventional example, as the detecting device 1, the detecting unit 2 including the light emitting element and the light receiving element must be installed in a spaced relation at an opposing position, when the document d contained in the document container 5 is not present on the actuating member 4. Accordingly, the number of component parts increases and a space occupied for detecting the document feeding state becomes larger to deteriorate the utilization efficiency of space.

FIG. 2 is a schematic sectional view showing a second conventional example. The actuating member 4 is pivoted rotatably on a machine body 9, and at one end 4*b* thereof, a spring 7 is fixed between the machine body 9 to urge the other end 4*a* contacted to the document d contained in the document container 5 from the underside upward. In the vicinity of the actuating member 4, a light receiving element 8 which receives light from a light emitting element, not shown, disposed perpendicularly above the paper surface of FIG. 2 is installed on the machine body 9.

When the documents d are contained in the document container 5 in stack, the other end 4*a* of the actuating member 4 contacts to the document positioned at the bottom of the documents d received from the underside. As same as the first conventional example, the documents d are fed seriatim from the one on top from the document container 5, and when it is returned to the bottom, the downstream end portion in the receiving direction of the document returned is inserted underneath the other end 4*a* of the actuating member 4. Thereby, associated with the feeding and returning operation of the document d, the other end 4*a* of the actuating member 4 displaces gradually upward by the spring 7, accordingly, one end 4*b* of the actuating member 4 displaces in the opposite direction of the other end 4*a*. When all of the documents divided by the actuating member 4 and contained in the document container 5 without being fed are fed, a path of light received by the light receiving element 8 from the light emitting element is interrupted by one end 4*b* of the actuating member 4, thereby detecting feeding of all of the documents d.

In this second conventional example, when the weight of the documents d is light, or the number of document sheets which are divided by the actuating member 4 and not fed decreases, the other end 4*a* of the actuating member 4 tends to push up the documents not fed and displace angularly by the force of the spring 7, thereby such a situation may occur that one end 4*b* of the actuating member 4 interrupts the light path of the light receiving element 8. In this case, the detecting signal indicating that all of the documents d were fed is emitted in spite of the documents d being not fed all, thereby causing malfunction.

FIG. 3 is a view showing a third conventional example disclosed in U.S. Pat. No. 4,639,126, and FIG. 4 is a view illustrating its operation. A follow-up-finger which moves as following a document stack 59, which is fed for copying, from the under side is constituted by including a light and small coil spring 80, and its tip is provided with a plug 81 consisting of a synthetic resin. The spring 80 is installed on a member 82 consisting of a synthetic resin and disposed rotatably about an axis of a shaft 83. A second coil spring 84 is also mounted to the member 82, and a weight 85 consisting of a metallic material is provided at one end thereof. The springs 80 and 84 are disposed at an angular relation-ship of 90° or more.

To a plunger of a solenoid 87, a first link 88 is connected by a pin, and to the first link 88 a second link 89 is connected by a pin. The member 82 is pivoted on the second link 89 by the shaft 83, and the second link 89 is installed on a mounting shaft 60 provided on the machine body so as to be able to displace angularly.

Referring to FIG. 4, as long as, at least, a sheet of document is present on the spring 80, the follow-up finger is retained at a position shown in FIG. 4 (2), and the spring 80 is extended substantially horizontally under the document. While, as shown in FIG. 4(3), when the last document is taken out, the weight 85 acts on the member 82 and the springs 80, 84 displace angularly about the shaft 83 by gravity of the weight 85. At a position shown in FIG. 4(3), the springs 80, 84 are both extended in a direction of about 45° from a level. Associated with a sensor 86, the spring 80 is stopped and the follow-up finger is retained at a position shown in FIG. 4(3).

By movement from the position of FIG. 4(2) to that of FIG. 4(3), the spring 80 passes through the front of the sensor 86 and the signal indicating that the last document has been fed for copying from the document stack 59 is sent.

After the last sheet of document stack 59 is returned to a tray, the solenoid 87 is excited. By operation of the solenoid 87, the spring 80 is reset under the last sheet of the document stack 59 as shown in FIG. 4(4).

The solenoid 87 is excited for a short period of about 500 m sec., and during this period, the link 88 is pushed upward and retained. To the upper end of the link 88, the second link 89 is coupled so as to be able to displace angularly. As the link 88 moves upward, the link 89 displaces angularly about the mounting shaft 60. By this angular displacement, the link 89 moves to a substantially horizontal position as shown in FIG. 4(4). At this position, by the operation of the weight 85, the spring 84 moves to a substantially horizontal position, and the spring 80 moves to a substantially vertical position.

As shown in FIG. 4(4), the spring 80 is balanced at the position where its plug 81 directs downward so as to be inserted under the document stack 59. Next, when the solenoid 87 is deenergized, the link 88 moves in a substantially vertical direction and the link 89 is brought to a substantially vertical position, and as shown in FIG. 4(1), by the operation of the weight 85, the member 82 rotates so as to insert the spring 80 under the document stack 59. Thereby, the document stack 59 can be circulated for copying.

In the third conventional example, since the links 88, 89, solenoid 87 and further the sensor 86 are provided to detect one circulation of the document stack 59, the number of component parts is increased by a complicated link mechanism, results in a high cost. Also, as the weight 85 provided on one end of the spring 84 is heavy, in case a sheet of document in the document stack 59 is relatively light, the plug 81 installed on the tip of the spring 80 may push up a few documents remained without being fed and detected by the sensor 86, thus detection of completion of feeding may be led to malfunction.

As such, according to the first conventional example, the space utilization efficiency is deteriorated by the detecting unit 2, and according to the second conventional example, completion of feeding may be detected improperly for the lightweight documents, and further, according to the third conventional example, improper detection for the lightweight documents is apt to occur, besides the number of component parts for detection becomes larger to result in a high cost.

In the recirculating document feeder aforementioned, a circulation path which returns to a document container again from the document container via a reading station is formed, and documents are fed such that, for example, the document on top of the documents stacked on the document container is fed seriatim and returned to the document container at the bottom of the stacked documents.

As a configuration for realizing the feeding operation of the documents above-mentioned, it may be considered, for example, to provide a vacuum suction unit and a conveying belt integrated with each other, on the upper side of a stack of documents. That is, a sheet of document on top of the document stack is sucked onto the peripheral surface of the belt by the vacuum suction unit, and fed by driving the belt in this state.

In such a feeder, multiple feeding of the documents which feeds a plural sheets of document at the same time is apt to occur, thus detecting one circulation of feeding and returning the document is unstable.

Besides, when the document fed is returned between the stack of documents and placing member where on the stack of documents is placed, the document being returned may be damaged.

SUMMARY OF THE INVENTION

It is an object of the present invention to provide a recirculating sheet feeder, in which reliability of the feeding operation can be improved at a low cost by providing a detecting device, which detects all of a plural number of stacked sheets in each group by a relatively simple configuration in a narrow occupied space.

It is another object of the invention to provide a recirculating sheet feeder, in which a sheet on top of the stacked sheets can be fed seriatim reliably, and damages on the sheet after return can be reduced.

The invention is a recirculating sheet feeder, in which a sheet on top of the stacked sheets is fed seriatim and returned to the bottom of the stacked sheets, the recirculating sheet feeder comprising, a placing member whereon a stack of sheets is placed, feeding means for feeding the sheets stacked on the placing member, a detecting protrusion which is able to contact to the lower surface of the sheet on the placing member, and disposed rotatably about an axis extending along the placing member, a spring for urging the detecting protrusion upward, detecting means for detecting displacement of the detecting protrusion by the spring when the sheet is not present on the placing member, a pressing member which presses the sheets by hindering the upward displacement of the sheets stacked on the placing member, and driving means for rotating the detecting protrusion.

According to the invention, the sheets are stacked on the placing member and fed seriatim from the one on top thereof by the feeding means.

Along the placing member, the detecting protrusion is disposed rotatably about an axis extending along the placing member. The detecting protrusion is rotated by the driving means and contacts to the lower surface of the sheets stacked on the placing member. The detecting protrusion thus contacted is urged upward to the side of the stacked sheets by the spring. While, the pressing means is provided above the stacked sheets, whereby the upward displacement of the sheets stacked on the placing member due to the spring force of the detecting protrusion by the spring is kindred. In this state, the sheet on top of the sheets stacked on the placing member is fed seriatim, and when the sheet to which the detecting protrusion is contacted is not present on the placing member, the detecting protrusion displaced angularly by the spring and this angular displacement is detected by the detecting means. In this way, it is detected that all of the sheets stacked on the placing member were fed.

According to the invention, the detecting protrusion disposed rotatably about the axis extending along the placing member is rotated by the driving means, and contacted to the lower surface of the sheets stacked on the placing member, and further, urged upward by the spring. While, the upward displacement of the sheets stacked on the placing member due to the spring force is hindered by the pressing means. Thereby, displacement of the detecting protrusion by the spring at absence of the sheet on the placing member between the detecting protrusion and the pressing means is adapted to be detected by the detecting means so that completion of feeding the sheets can be detected reliably, and reliability of the detecting operation is improved. Also, such a recirculating sheet feeder is realized by a relatively simple configuration and an occupied space can be reduced, results in reduction of cost.

The invention is a recirculating sheet feeder which includes a containing member containing sheets in stack, and in which the sheet is fed seriatim from the one on top of the stacked sheets and received at the bottom of the stacked sheets, the recirculating sheet feeder comprising, feeding means for feeding a sheet seriatim from the one on top of the stacked sheets, conveying means for conveying the sheet conveyed from the downstream side in the sheet feeding direction of the containing member to the bottom of the sheets contained, urging means for urging the sheets contained partially upward in the stacking direction, at an end position on the upstream side in the feeding direction of the sheet in the containing member, and detecting means for detecting that the sheet to be urged upward by the urging means is not present.

According to the invention, the sheets contained in the containing member in stack are fed seriatim from the one on top by the feeding means. Also, to the containing member, the sheet conveyed from the downstream side in the sheet feeding direction by the feeding means is conveyed and received at the bottom of the sheets.

At this time, to the sheets in the containing member, a force is applied partially upward in the stacking direction by the urging means, at an end position on the upstream side in its feeding direction. Thereby, a stacking load of the sheets relative to the containing member is reduced, and preferably, a space is formed between the sheets and the containing member to facilitate transportation of the sheets by the conveying means.

Furthermore, the detecting means is provided on the sheet container and feeder to detect the presence with respect to the sheet urged upward by the urging means in the containing member, thereby detecting completion of feeding the sheets contained in the containing member in stack.

According to the invention, since the sheets are urged partially upward in the stacking direction by the urging means, at an end position on the upstream side in the feeding direction of the sheets contained in the containing member, the sheet can be easily conveyed to the bottom of the sheets contained by the conveying means. Thereby, damages of the sheet at return is reduced and quality of the returning operation is improved.

The invention is a recirculating sheet feeder which includes a placing member containing sheets stacked on the placing member is fed and received at the bottom of the stacked sheets, the recirculating sheet feeder comprising, a detecting protrusion which is able to contact to the bottom of the sheets on the placing member and urging the stack upward, pressing means disposed above the sheets which are urged upward by the detecting protrusion for regulating the upward displacement of the sheets, conveying means for conveying the sheets fed to the underside of the detecting protrusion, and driving means for moving the detecting protrusion to the bottom of the sheets, when the sheet to be urged by the detecting protrusion is not present.

The invention is a recirculating sheet feeder which is characterized in that, the detecting protrusion includes detecting means, in which the contact between the detecting protrusion and the sheet is movable upward beyond the contact between the pressing member and the sheet, for detecting one circulation of the sheet by the operation of the detecting protrusion, after the detecting protrusion has moved upward by and the contact between the pressing member and the sheet.

The invention is a recirculating sheet feeder characterized in that, the pressing member is disposed so as to be able to open and move upward when the sheets are placed on the placing member.

Also, the invention is a recirculating sheet feeder comprising, receiving means for receiving the pressing member when the sheets are placed on the placing member.

The invention is a recirculating sheet feeder which includes a placing member containing the sheets in stack, feeding the sheet on top of the sheets stacked on the placing member and receiving at the bottom of the stacked sheets, the recirculating sheet feeder comprising, a detecting protrusion which is able to contact to the bottom of the sheets on the placing member, and urged upward, and a matching member formed with a matching face which contacts to the downstream end face in the feeding direction of the stacked sheets to match the end face, when the sheet is urged upward by the detecting protrusion.

Also, the invention is a recirculating sheet feeder characterized in that, the upper portion of the matching face is formed by protruding toward the downstream side in the feeding direction of the sheet beyond the lower portion thereof.

BRIEF DESCRIPTION OF THE DRAWINGS

Other and further objects, features, and advantages of the invention will be more explicit from the following detailed description taken with reference to the drawings wherein:

FIG. 19 to FIG. 21 are views for explaining the configuration and operation of still another embodiment of the invention.

DETAILED DESCRIPTION OF THE PREFERRED EMBODIMENTS

Figure 1:
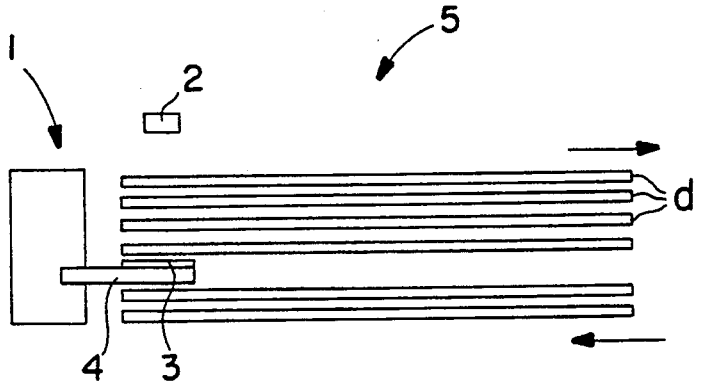
FIG. 1 PRIOR ART
FIG. 1 is a view showing a first conventional example.
Figure 2:
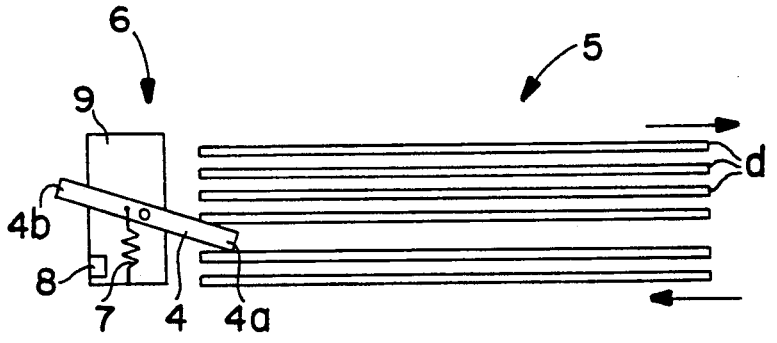
FIG. 2 PRIOR ART
FIG. 2 is a view showing a second conventional example.
Figure 3:
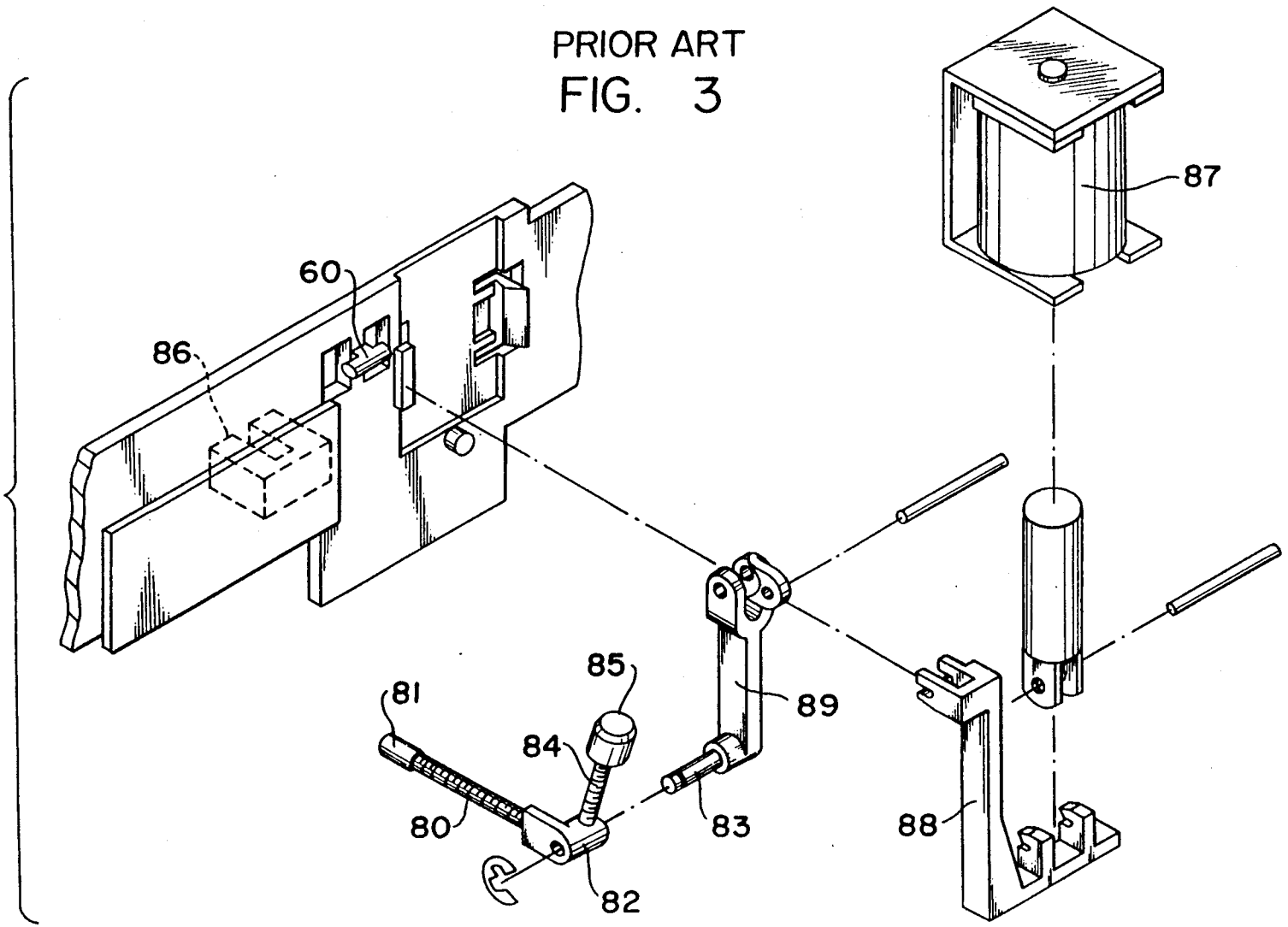
PRIOR ART FIG. 3
FIG. 3 is an exploded perspective view showing a third conventional example, FIGS. 4 (1–4) are views showing the operation of the third conventional example.
Figure 4:
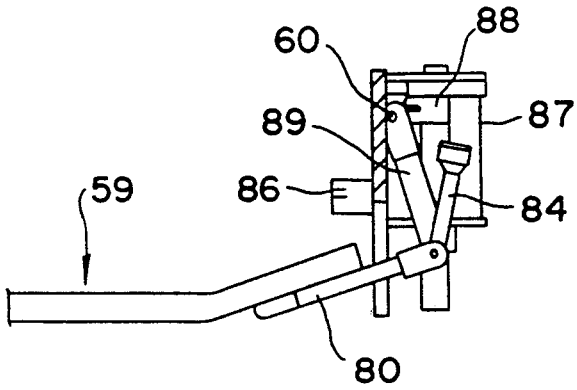
FIG. 4(1) PRIOR ART
Figure 4:
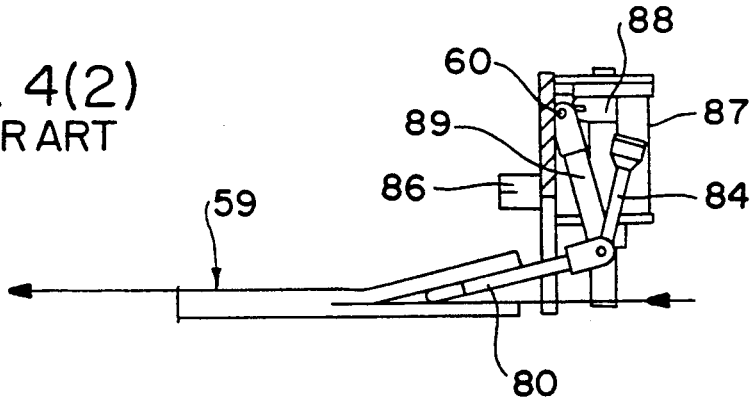
FIG. 4(2) PRIOR ART
Figure 4:
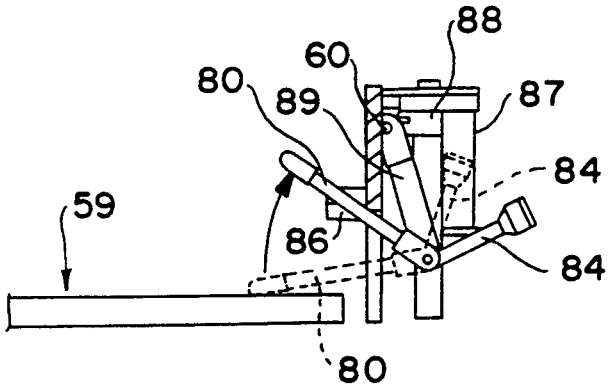
FIG. 4(3) PRIOR ART
Figure 4:
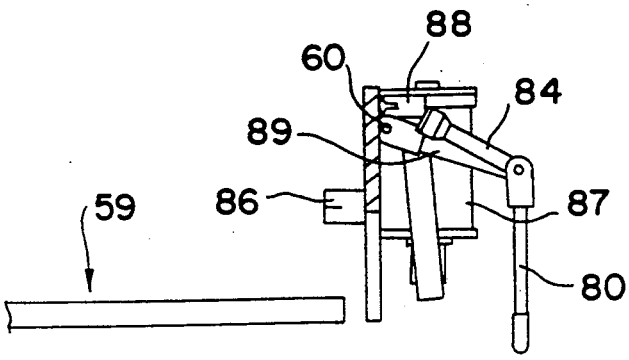
FIG. 4(4) PRIOR ART

Now referring to the drawing, preferred embodiments of the invention are described below.

Figure 5:
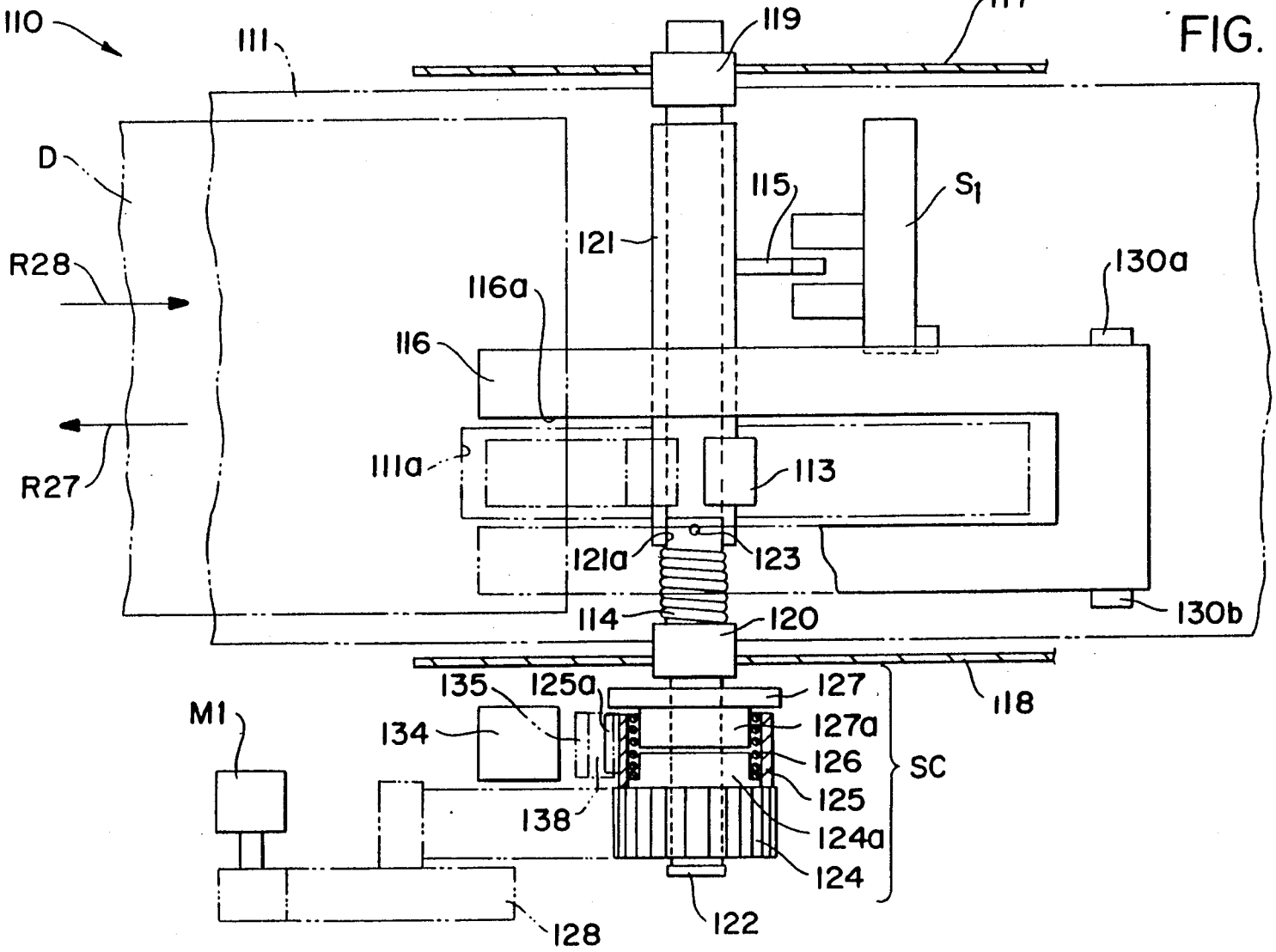
FIG. 5 is a plan view showing a basic configuration of a first embodiment of the invention.
Figure 6:
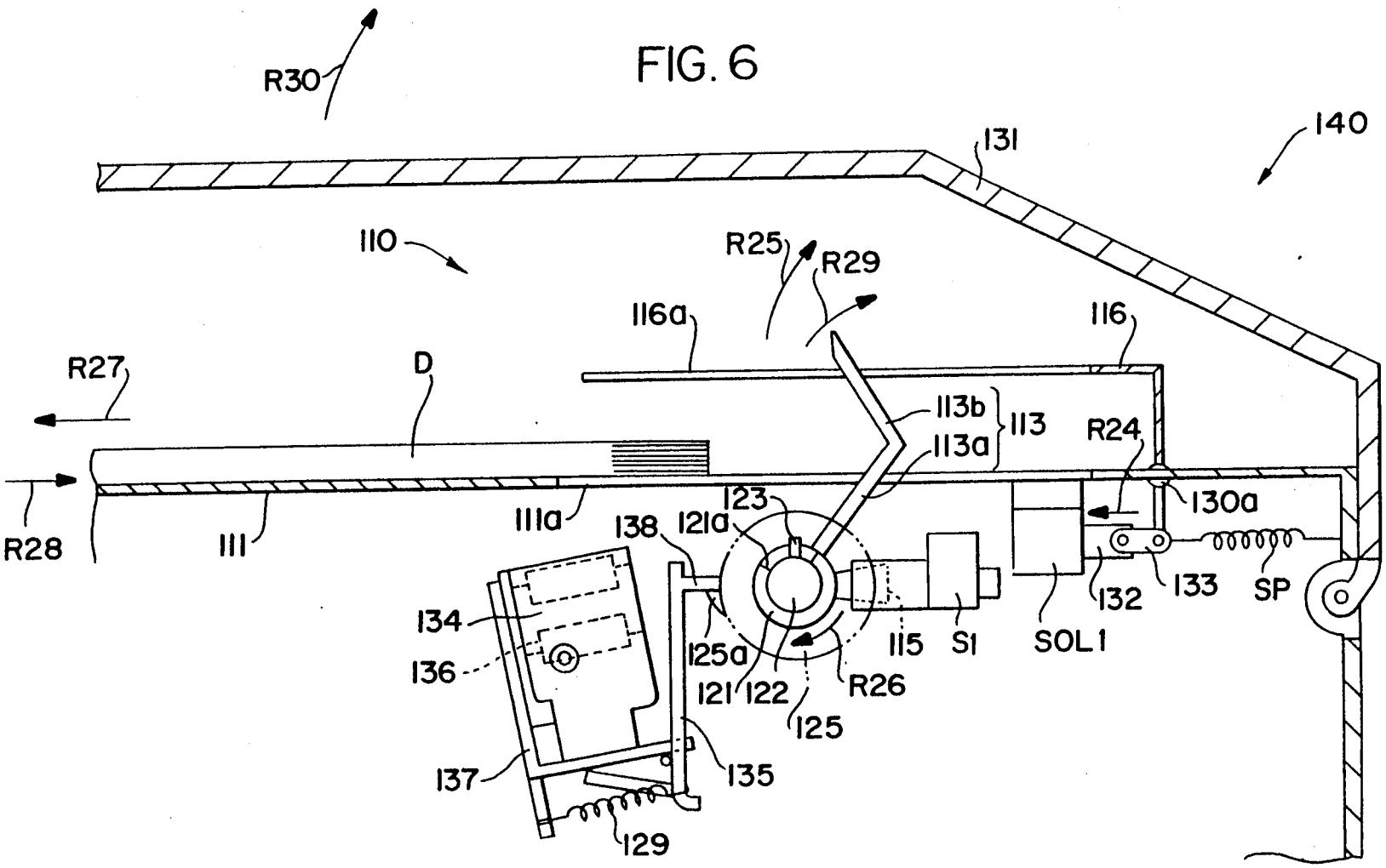
FIG. 6 is a sectional side view thereof.
Figure 7:
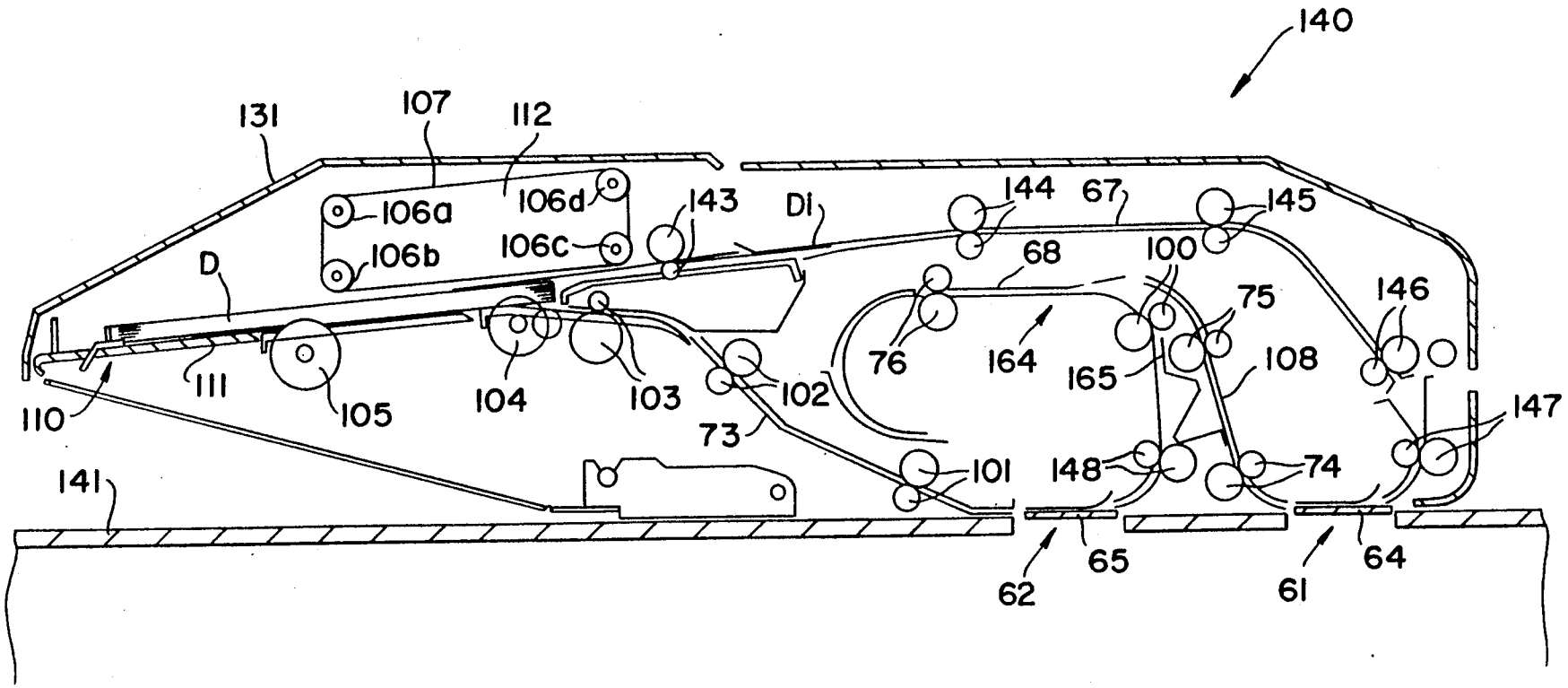
FIG. 7 is a schematic sectional side view showing a document feeder 140.

FIG. 5 is a plan view showing a basic configuration of one embodiment of the invention, FIG. 6 is a sectional side view thereof and FIG. 7 is a schematic sectional side view showing a recirculating document feeder 140 according to the invention. Thus, FIG. 6 is a side view looking the document feeder 170 from the back side of FIG. 7.

The document feeder 140 is installed in a transfer type electrostatic copying machine 142 (refer to FIG. 10 to be described later) for use, in which a plural number of document sheets D placed on a placing member 111 in stack are conveyed to a transporting path 67 by feeding means 112, and one surface there of is presented at a first reading station 61 constituted by disposing a first transparent plate 64. The document completed with presentation is conveyed to an inverting path 68 via a transporting path 108, and after inverting the transporting direction of the document by the switch-back motion in the inverting path 68, the other surface is presented at a second reading station 62 constituted by a second transparent plate 65.

The document completed with presenting the both surfaces in returned to the bottom of the documents D placed on the placing member 111 via a transporting path 73 by receiving and conveying rollers 104, 105 and soon. In the placing member 111, a document detecting device 110 is provided on the downstream side in the receiving and conveying direction of the document, and one circulation of feeding operation of the document D placed on the placing member 111 to the first and second reading stations 61, 62 is detected.

Referring to FIG. 5 and FIG. 6, the document detecting device 110 with be described as follows. In relation to the placing member 111 where on the documents D fed circularly in the document feeder 140 are placed, a rotary shaft 122 having an axis extending along the placing member 111 thereunder is disposed rotatably in the horizontal rotating direction on side plates 117, 118 of a machine body by bearings 119, 120. On the rotary shaft 122, a supporting cylinder 121 provided with a detecting protrusion 113 for detecting one circulation of the document D and protruded on the radial peripheral portion is penetrated rotatably with each other between the side plates 117, 118. On the supporting cylinder 121, a light shielding detected piece 115 is fixed at a position shifted from the detecting protrusion 113, and a sensor S1 serving as optical detecting means is disposed on the machine body. In the sensor S1, angular displacement of the detecting protrusion 113 is detected by detecting that, light emitted from the light emitting element is interrupted by the detected piece 115 and not reaching the light receiving element.

On the rotary shaft 122, protruding outward from the side plate 118 of the machine body on the opposite side of the side plate 117, a spring clutch mechanism SC is disposed. The spring clutch mechanism SC is constituted by a transfer sleeve 127 fixed on the rotary shaft 122, a gear 124 pivoted rotatably on the rotary shaft 122, a coil spring 126 surrounding basses 127*a*, 124*a* apposing respectively to the transfer sleeve 127 and the gear 124, and further, an engaging claw member 125 surrounding the coil spring 126. In the vicinity of the spring clutch mechanism SC, electromagnet means 134 having a lever 135 engaged to the engaging claw member 125 is disposed. The electromagnet means 134 includes a coil and a yoke to which a lever 135 capable of sticking magnetically is disposed so as to be displaceable angularly, and urged in a direction aparting from a coil 136 by means of a spring 129.

A drive shaft of a motor M1 is coupled to the gear 124 of the spring clutch mechanism SC via a gear train 128. Thereby, a rotating power from the motor M1 is transmitted to the gear 124 via the gear train 128 to drive the gear 124 about an axis of the rotary shaft 122.

Meanwhile, on the placing member 111, a pressing member 116 which presses document sheets stacked on the placing member 116 to stop displacing upward is mounted by hinges 130*a*, 130*b* so as to be displace able angularly. A lower end of the pressing member 116 in relation to the placing member 111 is connected to a plunger 132 of a solenoid SOL1 by means of a pin via a link 133. On the link 133, a tension spring SP is installed between the machine body on the opposite side of the solenoid SOL1. By exciting the solenoid SOL1, the link 133 is driven in the direction of the arrow R24, thereby the pressing member 116 can be displaced angularly in the direction of the arrow R25 by a predetermined angle.

Such a pressing member 116 includes a substantially U-shaped opening 116*a* as shown in FIG. 5, and on the placing member 111 opposing the pressing member 116, an opening 111*a* is also formed at a position corresponding to the opening 116*a*. Thereby, the detecting protrusion 113 of the supporting cylinder 121 pivoted on the rotary shaft 122 having an axis extending along the placing member 111 between the sides plates 117, 118 is rotatable about the axis.

The detecting protrusion 113 comprises, a base portion 113*a* protruded on the radial peripheral portion of the supporting cylinder 121 penetrated on the rotary shaft 122, and a contact 113*b* which contacts to the lower surface of the documents D stacked on the placing member 111, which are formed into a substantially L-shaped body having a predetermined angle between each other as shown in FIG. 6.

When the rotating power from the motor M1 is transmitted to the gear 124 via the gear train 128 from the position shown in FIG. 6, the rotating power thus transmitted drives the rotary shaft 122 via the spring clutch mechanism SC. At a predetermined center portion in an axial direction of the rotary shaft 122, a pin 123 is pressed in radially, and moves about the axis in a notch 121*a* of the supporting cylinder 121, thereby contacting to the inner surface of the notch 121*a* to rotate the supporting cylinder 121 in the direction of the arrow R26. Thereby the detecting protrusion 113 protruded on the peripheral surface of the supporting cylinder 121 is also rotated in the direction of the arrow R26 through the openings 111*a*, 116*a* of the placing member 111 and the pressing member 116, as a result, the contact 113*b* is contacted to the lower surface of the documents D stacked on the placing member 111 and stopped.

When the rotating power of the motor M1 is further transmitted to the rotary shaft 122 in the state wherein the contact 113*b* of the detecting protrusion 113 contacts to the documents D, until a claw 125*a* of the engaging claw member 125 engages to a claw 138 of the lever 135 of the electromagnet means 134, a torsion spring 114, whose one end is fixed to the rotary shaft 122 and the other end to the supporting cylinder 121, is reduced diametrically. When the claw 125*a* of the engaging claw member 125 engages with the claw 138 of the lever 135, power transmission in the spring clutch SC is interrupted and the rotating power from the motor M1 is not transmitted to the rotary shaft 122.

In the state wherein the contact 113*b* of the detecting protrusion 113 is contacted to the lower surface of the document D and urged upward by a torsion force of the spring 114 reduced diametrically in such a way, when the documents D are fed seriatim from the one on top on the placing member 111 in the direction of the arrow R27 and returned from the direction of the arrow R28 to the bottom of the documents D, whereby the feeding operation of the documents is proceeded, though the number of documents on the contact 113*b* of the detecting protrusion is decreased and pushed upward, the upward displacement is regulated at a position where the document D is contacted to the pressing member 116.

When the document D between the contact 113*b* of the detecting protrusion 113 and the pressing member 116 is used up, the detecting protrusion 113 looses its support and displaces angularly in the direction of the arrow R29 due to the torsion force of the spring 114. This angular displacement is stopped at a position, where the end face of the supporting cylinder 121 on the upstream side in the rotating direction R26 in the notch 121*a* contacts to the pin 123 pressed into the rotary shaft 122. At this time, associated with the angular displacement of the detecting protrusion 113, the detected piece 115 of the supporting cylinder 121 interrupts the light path of the sensor S1, thereby detecting the angular displacement of the detecting protrusion 113.

In the document feeder 140, above the documents D placed on the placing member 111, a cover 131 is disposed in an open-and-close fashion about a shaft coupled to a bracket of the machine body by means of a pin. the open-and-close operation of the cover 131 is detected by detecting means, not shown, to control energizing/deenergizing of the solenoid SOL1. Thereby, when the cover 131 is open, the pressing member 116 is also released to facilitate placing of the documents D on the placing member 111, and when the cover 131 is closed, the pressing member 116 is also arranged above the documents D stacked on the placing member 111 to stop the upward displacement of the documents D.

Figure 8:
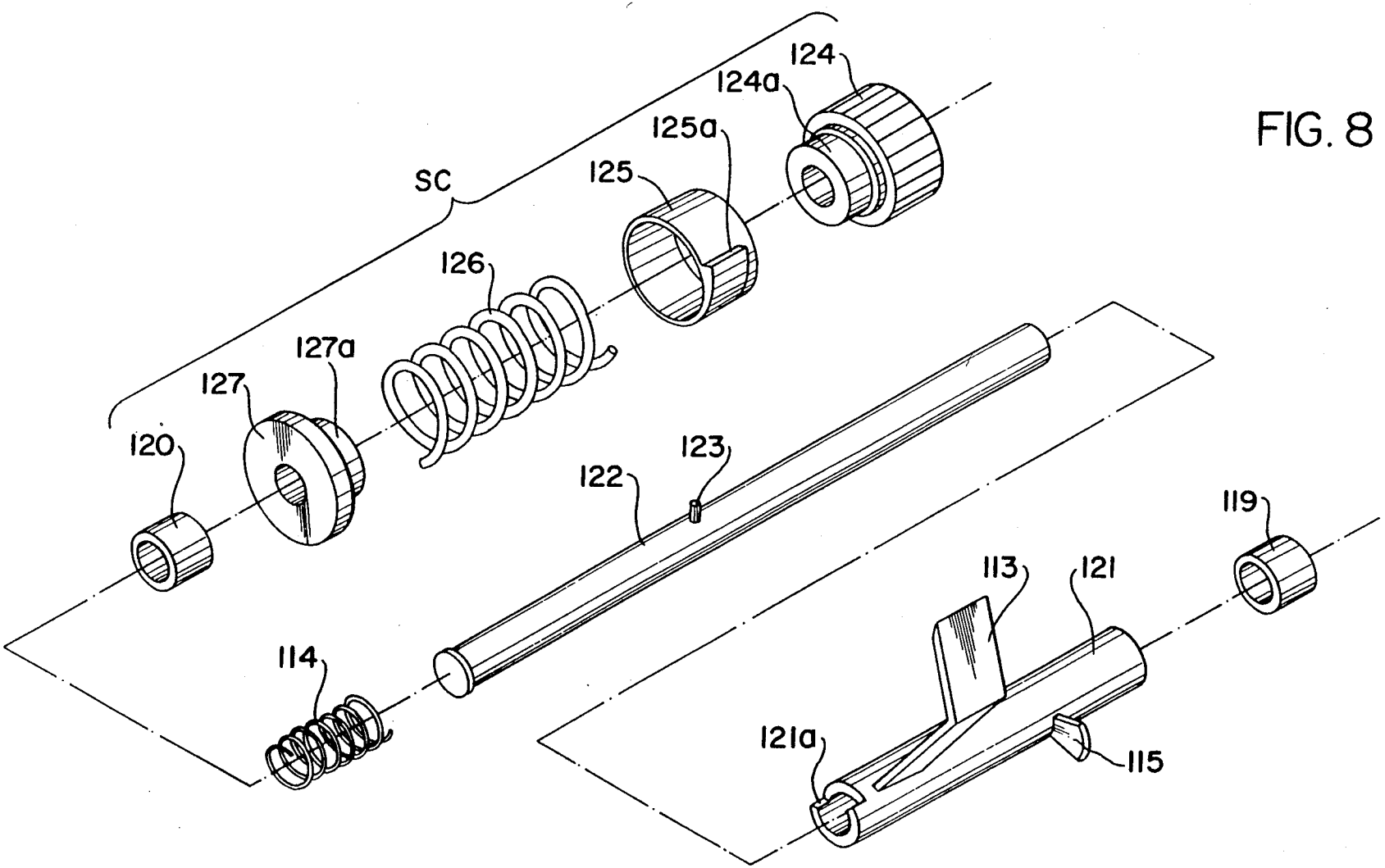
FIG. 8 is an exploded perspective view showing a configuration related to a rotary shaft 122.

FIG. 8 is an exploded perspective view showing a configuration related to the rotary shaft 122 of the document detecting device 110. Referring to FIG. 5 and FIG. 6 together, the rotary shaft 122, into which the pin 123 is pressed at the radial peripheral portion in the center along the axial direction, and on which the supporting cylinder 121 is penetrated rotatably with each other, is supported by a pair of bearings 119, 120 and mounted on the side plates 117, 118. On the rotary shaft 122, the torsion spring 114 is penetrated and fixed to the rotary shaft 122 at one end and to the supporting cylinder 121 at the other end.

The spring clutch mechanism SC provided outside the side plate 118 is constituted by the gear 124 disposed on the primary side with respect to transmission of the rotating power from the motor M1, the transfer sleeve 127 disposed on the secondary side, the coil spring 126 surrounding the basses 124*a*, 127*a* of the gear 124 and the transfer sleeve 127 to transmit and interrupt the power by reducing diametrically, and the engaging claw member 125 surrounding the coil spring 126.

The gear 124 is pivoted on the rotary shaft 122 rotatably with each other, and the transfer sleeve 127 is fixed on the rotary shaft 122. The coil spring 126 surrounding the boss 124*a* of the gear 124 and the boss 127*a* of the transfer sleeve 127 is fixed to the engaging claw member 125 at one end and to the transfer sleeve 127 at the other end. A winding direction of the coil spring 126 is fixed in fastening direction of the two basses 124*a*, 127*a* by the coil spring 126 reduced diametrically by the rotating power transmitted to the gear 124 from the motor M1 via the gear train 128.

Thereby, in the state wherein the claw 138 of the lever 135 is engaged to the engaging claw member 125*a*, the two basses 124*a*, 127*a* are never fastened by the coil spring 126 at rotation of the gear 124. While, when the engagement between the claw 125*a* of the engaging claw member 125 and the claw 128 is released, the coil spring 126 fastens the two basses 124*a*, 127*a* by the rotating power from the gear 124. Accordingly, the rotating power transmitted to the gear 124 is transmitted to the rotary shaft 122 from the boss 124*a* of the gear 124 via the bass 127*a* of the transfer sleeve 127. The rotating power of the rotary shaft 122 is transmitted to the supporting cylinder 121 via the torsion spring 114.

Figure 9:
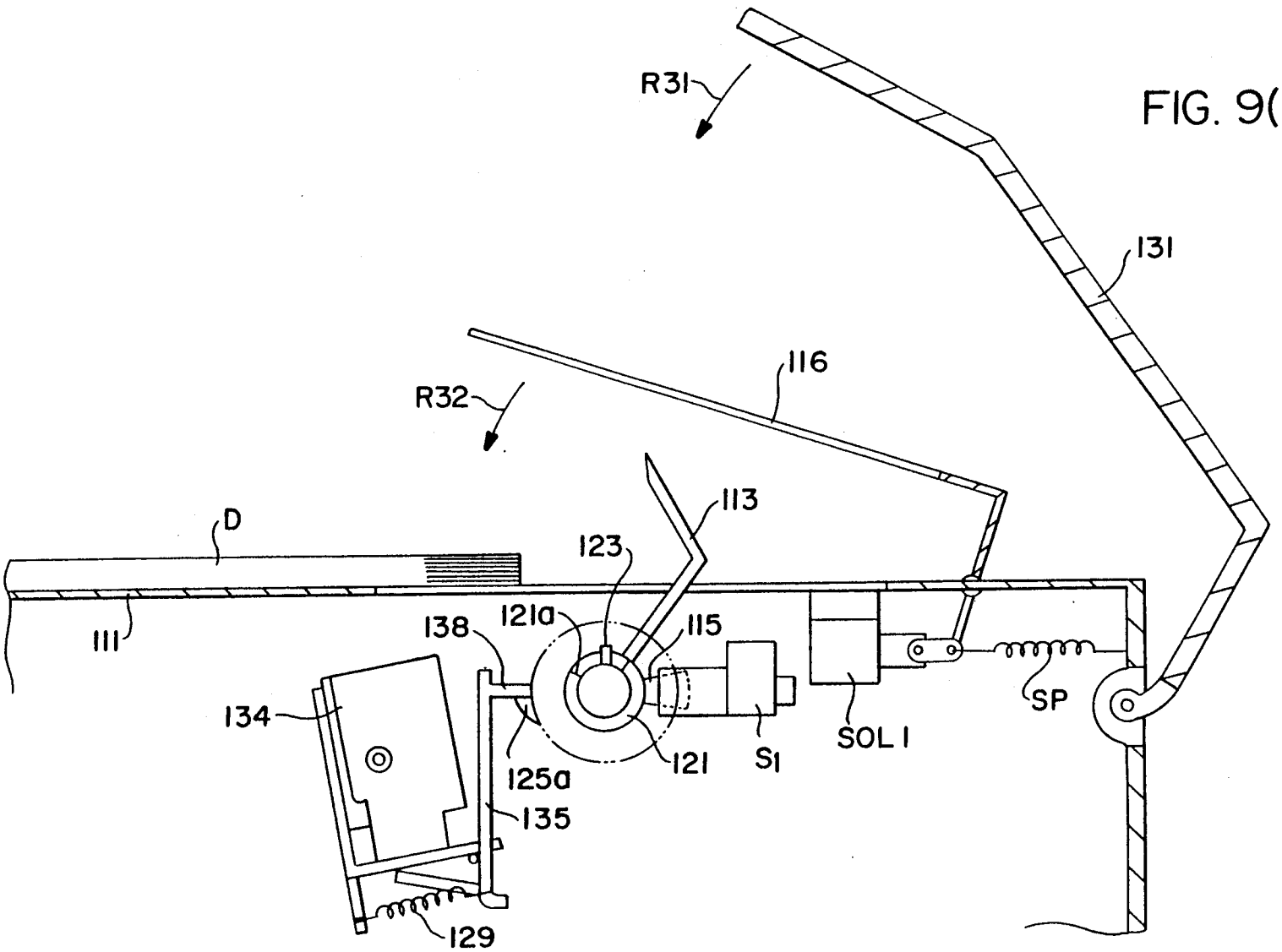
FIGS. 9 (1–4) are sectional side views for explaining the operation of a document detecting device 110.
Figure 9:
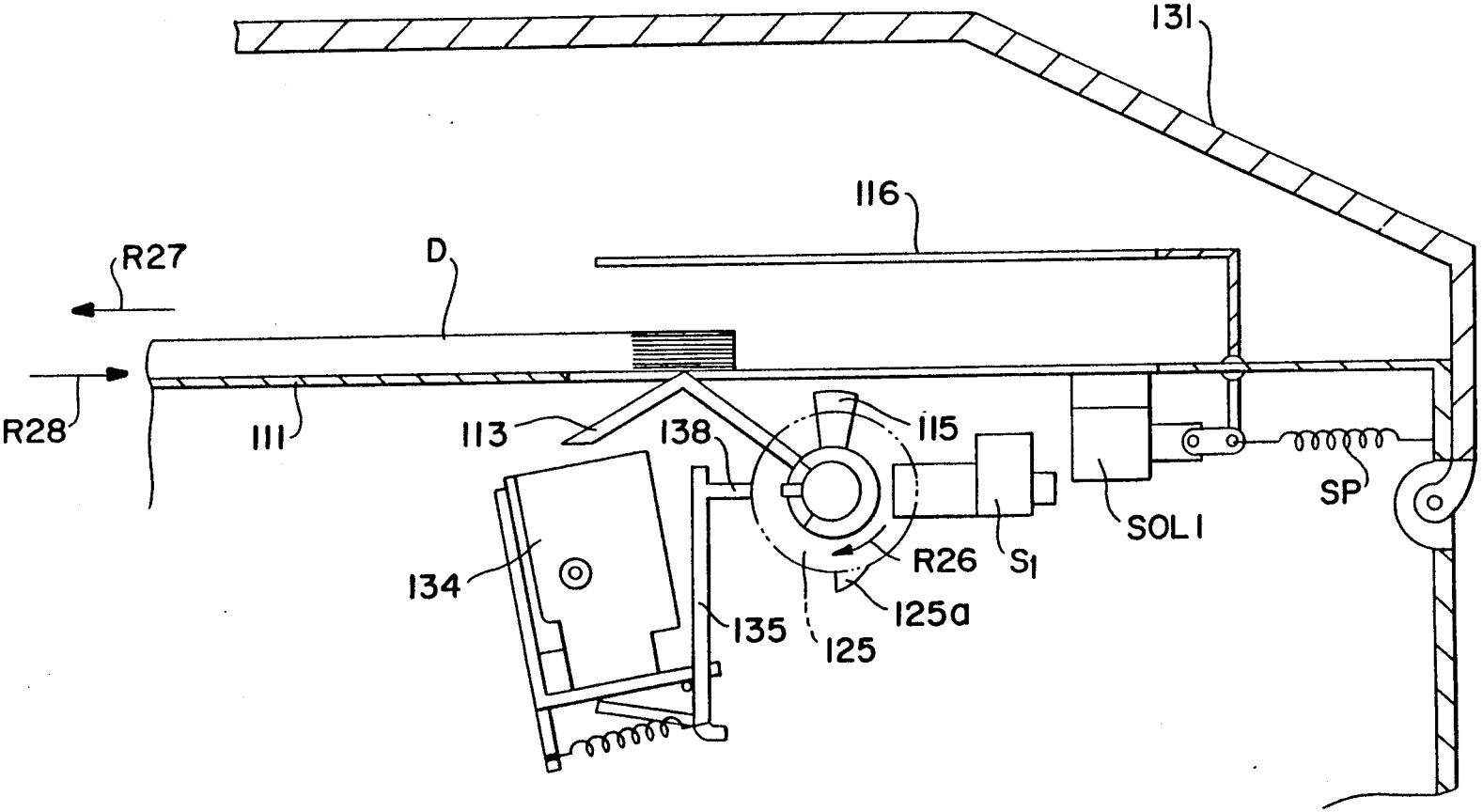
Figure 9:
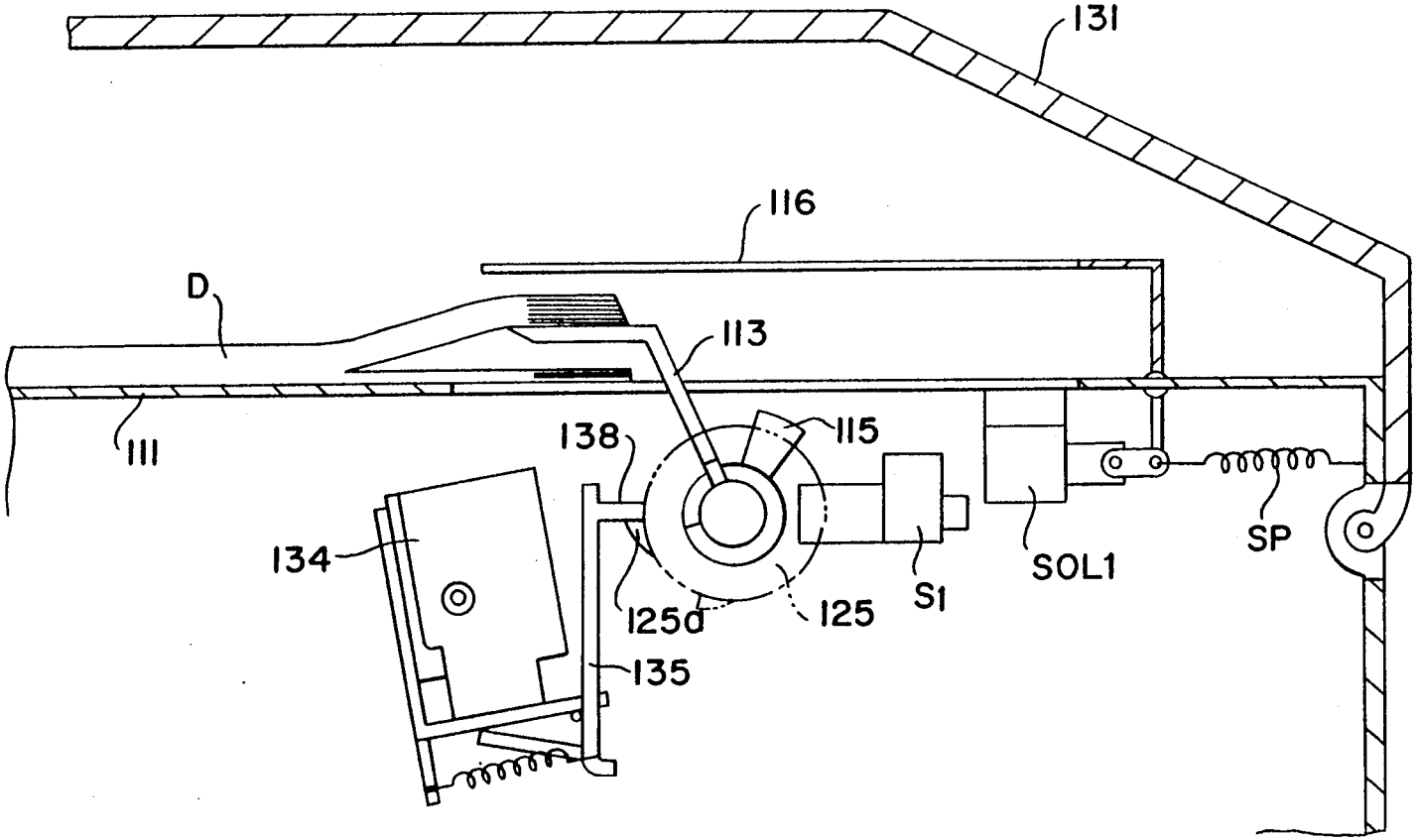
Figure 9:
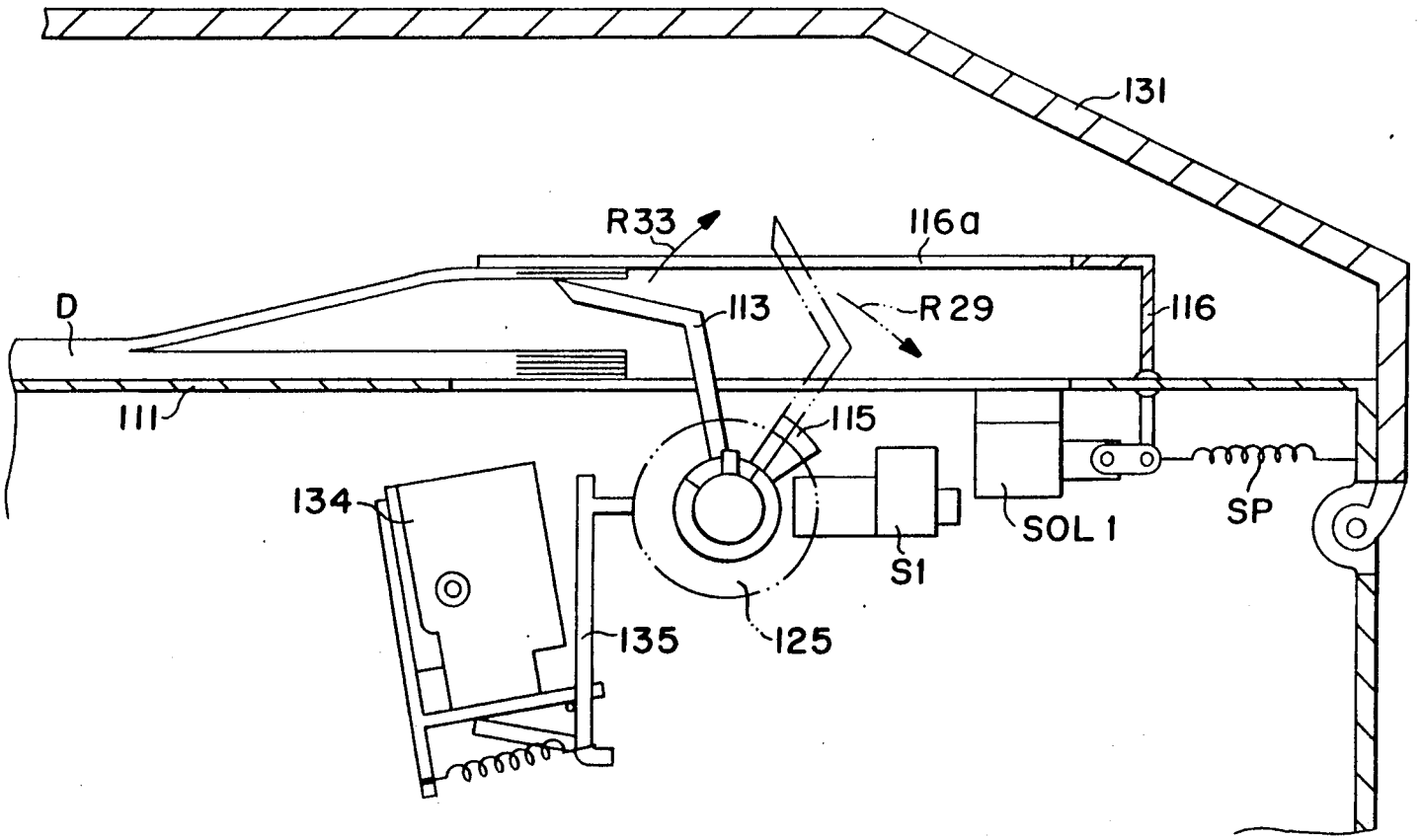

FIG. 9 is a sectional side view showing the operation of the document detecting device 110. When the copying machine 142 including the document feeder 140 is used for copying, the operator first places the documents D on the placing table 111. At this time, by opening the cover 131 of the document feeder 140 in the direction of the arrow R30 as shown in FIG. 6, release of the cover 131 is detected by detecting means, not shown, disposed with respect to the cover 131 beforehand, thereby the electromagnetic solenoid SOL1 is energized and the pressing member 116 is also released in the direction of the arrow R25 against the tension force of the tension spring SP, whereby the state shown in FIG. 9(1) is attained to facilitate the placing operation of the documents D onto the placing member 111.

When the cover 131 is closed in the direction of the arrow R31 after placing the documents D on the placing member 111 in the state shown in FIG. 9(1), this is detected to deenergize the electromagnetic solenoid SOL1, and the pressing member 116 is also displaced angularly in the direction of the arrow R32 by the tension force of the tension spring SP and arranged above the documents D. Thereby, the upward displacement of the documents D may be hindered by the pressing member 116 on the placing member 111.

When the document feeder 140 starts to operate in the state wherein the documents D are received in the document feeder 140, the motor M1 shown in FIG. 5 is started and the rotating power is transmitted to the gear 124 via the gear train 128. Next, by energizing the electromagnet means 134, the lever 135 is attracted toward the core 136 against the tension force of the spring 129, thereby the lever 135 disengages from the engaging claw member 125. Accordingly, the rotating power transmitted to the gear 124 is transmitted to the rotary shaft 122 via the spring clutch SC which is brought in engagement by reducing the coil spring 126 diametrically. By rotating the rotary shaft 122, the pin 123 is contacted to the end face on the downstream side in the rotating direction in the notch 121*a* of the supporting cylinder 121, which is rotated in the direction of the arrow R26. Thereby, the detecting protrusion 113 is also rotated in the direction of the arrow R29.

At this time, in case there is no documents D placed on the placing member 111, at a position where the supporting cylinder 121 including the detecting protrusion 113 has revolved 360° from the position shown in FIG. 6, the detected piece 115 interrupts the light path and the detecting signal is led out from the sensor S1. Thereby, it is judged whether the feeding operation of the document feeder 140 is stopped or continued.

When the documents D are placed on the placing member 111 beforehand, the detecting protrusion 113 is rotated in the direction of the arrow R26, and the contact 113*b* is contacted to the lower surface of the documents D through the opening 111*a* of the placing member 111 and its movement is regulated as the state shown in FIG. 9(2).

By transmitting the rotating power further to the rotary shaft 122 from the gear 124 in the state shown in FIG. 9(2), the torsion spring 114 fixed to the rotary shaft 122 at one end is twisted in the diametrically reducing direction. Next, by rotating the engaging claw member 125 of the spring clutch SC in the direction of the arrow R26 to engage the claw 125*a* to the claw 138 of the lever 135, the spring clutch SC is disengaged, and the rotating power is not transmitted to the rotary shaft 122 from the gear 124. In this state, in the supporting cylinder 121 including the detecting protrusion 113, the pin 123 pressed into the rotary shaft 122 is displaceable angularly between the opposite end faces in the rotating direction of the notch 121*a* of the supporting cylinder 121, and the contact 113*b* urges the documents D upward by the aforementioned torsion spring 114 reduced diametrically.

As shown in FIG. 9(3), when the document D is returned at the bottom of the documents D from the direction of the arrow R28, after the document D is fed seriatim from the one on top in the direction of the arrow R27 from the state shown in FIG. 9(2), the detecting protrusion 113 displaces upward in connection with feeding and returning of the document D, and interposes between the documents not fed and the document returned to divide the two documents.

Furthermore, as shown in FIG. 9(4), even in case the feeding operation of the documents D has proceeded and the number of documents not being fed decreases to reduce the weight, the upward displacement of the documents not being fed by the detecting protrusion 113 is hindered by the pressing member 116 disposed above the documents D.

When the last document interposed between the detecting protrusion 113 and the pressing member 116 and not being fed is fed from the state shown in FIG. 9(4), the supporting cylinder 121 is rotated about the rotary shaft 122 by the torsion spring 114, and the detecting protrusion 113 is displaced angularly in the direction of the arrow R33 through the opening 115*a* of the pressing member 116. The supporting cylinder 121 displaces angularly to a position where the end face on the upstream side in the rotating direction of the notch 121*a* is contacted to the pin 123 which stops together with the rotary shaft 122 and stops. At this time, the detected piece 115 provided on the supporting cylinder 121 interrupts the light path of the sensor S1, thereby the detecting signal indicating that one circulating of the document D is completed is led out. In response to this detecting signal, it is judged whether the document feeder 140 and the copying operation in the copying machine 142 is stopped or continued.

When the feeding operation of the document D in the document feeder 140 is restarted, the detecting protrusion 113 is rotated in the direction of the arrow R29, and arranged at the positions shown in FIG. 9(2) to repeat the operation above-mentioned.

As explained heretofore, according to the embodiment, since the pressing member 116 is disposed above the documents D stacked on the placing member 111, floating of the document D due to a torsion force of the torsion spring 114 in case the number of documents D being fed is few on decreased, on when the thin documents are placed and the tore is light, can be restrained and improper detection of one circulation of the document can be prevented.

Also, as the pressing member 116 is open and closed in connection with the open-and-close operation of the cover 131 of the document feeder 140, the operator may just operate the cover 131, thus the documents can be placed simply on the placing member 111. Thus, it is not necessary to operate the pressing member 116, improving the operability.

As such, according to the embodiment, one circulation of completion of feeding the documents D in the document feeder 140 can be detected reliably by the document detecting device 110 having a relatively simple configuration and occupying only a small space, thus the cost can be reduced.

Figure 10:
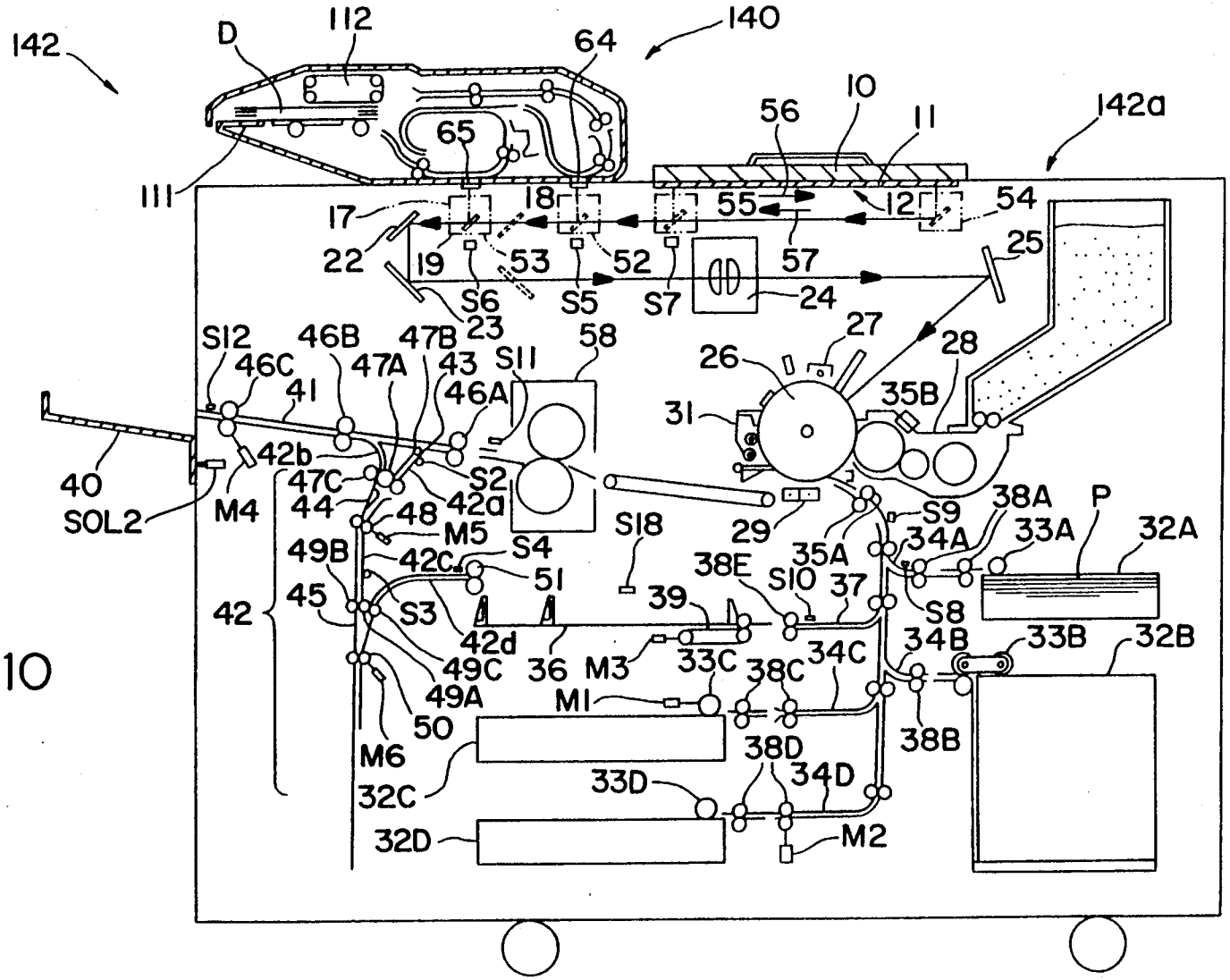
FIG. 10 is a schematic sectional view showing a basic configuration of a copying machine 142 including the document feeder 140.

FIG. 10 is schematic sectional view showing a basic configuration of the copying machine 142 provided with the document feeder 140 including the document detecting device 110.

On the main body 141 of the copying machine 142, the document feeder 140 and a pressing plate 10 are disposed. The first transparent plate 64 and the second transparent plate 65 provided on the document feeder 140 respectively constitute the first reading station 61 and the second reading station 62.

In relation to the pressing plate 10, on a pressed surface of the main body 141, a third transparent plate 66 is formed to constitute a third reading station 63. A document image of a book bound is presented at the third reading station 63 for exposure.

Referring to FIG. 7, a plural number of document sheets D of same size arranged in order of page number are placed on the placing member 111 of the document feeder 140 such that the document face of the first page is directed downward. The documents D placed on the placing member 111 is taken out seriatim from the one on top by the feeding means 112 disposed there above, and fed to the transporting path 67 by a feed roller 143. The feeding means 112 is constituted by a feed belt 107 installed on rollers 106*a*, 106*b*, 106*c* and 106*d*.

The transporting path 67 includes a pair of guide members and pairs of plural rollers 144, 145 and 146, and conveys the document Di fed onto the first transparent plate 64. Here, at an outlet of the transporting path 67 on the side of the first transparent plate 64, a pair of first resist rollers 147 are provided. To the rotary shaft of the first resist rollers 147, power transfer means is coupled via a clutch CLT1 not shown. By on/off control of the first resist rollers 147 by connecting/disconnecting control of the clutch CLT1, the conveying timing of the document Di to the first transparent plate 64 is controlled.

By conveying the document Di on the first transparent plate 64, a document image of its one surface is presented at the first reading station 61. Next, the document Di is conveyed on to the second transparent plate 65 by a pair of second resist rollers 148, after its conveying direction is inverted by inverting means 164. In the inverting means 164, the document Di from the first transparent plate 64 is conveyed to a transporting path 68 from a transporting path 108 formed by a pair of guide members and pairs of conveying rollers 74, 75 disposed along the conveying direction. In the transporting path 68, an inverting roller 76 which is rotatable in both directions is disposed, and the document Di conveyed to the transporting path 68 is conveyed to a transporting path 165 by inverting the rotating direction of the inverting roller 76. The document Di led into the transporting path 165 is conveyed to the second resist rollers 148 by a pair of conveying rollers 100.

To the rotary shaft of the second resist rollers 148, power transfer means is coupled via a clutch CLT2 not shown. By on/off control of the second resist rollers 148 by connecting/disconnecting control of the clutch CLT2, the conveying timing of the document Di to the second transparent plate 65 is controlled. The document Di conveyed onto the second transparent plate 65 by the second resist rollers 148 presents a document image of its other surface at the second reading station 62, since its conveying direction has been inverted into the inverting means 164 beforehand.

The document Di whose images on both surfaces have been presented is guided through a transporting path 73 formed by a pair of guide members and pairs of conveying rollers 101, 102 provided along the conveying direction, and conveyed to the placing member 111 where on the documents D are placed by a pair of conveying rollers 103. The document Di being conveyed is returned and received at the bottom of the documents D placed on the placing member 111 by receiving and conveying rollers 104, 105 disposed along the placing member 111. On the downstream side in the receiving direction of the document in the placing member 111, the detecting device 110 aforementioned for detecting one circulation of the document in the placing member 111 is provided, the detecting device 110 detecting one circulation of document feeding by dividing the document which is still not fed and the document which has been returned, and detecting the presence of the stacked documents D.

Referring to FIG. 10, inside a main body 142*a* of the copying machine 142, exposure means 17 extending in a direction perpendicular to the paper surface relative to the upper face of the main body 142*a*, and driven in the directions of the arrows 56, 57 is disposed. The exposure means 17 includes a light source 18 realized by a halogen lamp and the like and a reflector 19. Light generated in the light source 18 is irradiated to the document surface and selectively absorved corresponding to document images. The reflected light from the document surface is guided to a right cylindrical photoreceptor 26 having an axial line vertical to the paper surface, through the reflectors 19, 22, 23, a zoom lens 24 and a reflector 25, and forms an image in an exposure region 26*a*.

Related to the photoreceptor 26, there is provided a corona discharger 27 for charging uniformly the surface of the photoreceptor 26 before exposure. As the light corresponding to the document image is led into the exposure region 26*a*, the surface of the photoreceptor 26 is selectively destaticized, and thereby an electrostatic latent image corresponding to the document image is formed. The electrostatic latent image is converted into a sensible toner image by the function of a developer 28 disposed on the down stream side in the rotating direction of the photoreceptor 26 beyond the exposure region 26*a*. The toner image is transferred onto a copying paper P conveyed by the structure to be described later, in a transfer region 30 by the function of the corona discharger for transfer 29. Toners remaining on the surface of the photoreceptor 26 after transfer are removed by a cleaning device 31. The copying paper P after transfer is conveyed to a fixing device 58, where the toner image transferred is heated and fixed.

Paper feed cassettes 32A to 32D for containing copying papers of different sizes respectively from its side wall are attached to the copying machine body 142*a*. From one of these paper feed cassettes 32A to 32D, the copying papers are fed seriatim from the one on top to the paper feed paths 34A to 34D as paper feed rollers 33A to 34D are selectively rotated by the driving means such as a motor M1. In the paper feed paths 34A to 34A and a paper feed path 37 from an intermediate tray 36 to be described later, conveying rollers 38A to 38E are disposed respectively, and these conveying rollers are driven and rotated by a motor M2. By the function of these conveying rollers 38A to 38D, the copying papers P from the paper feed cassettes 32A to 32D and the intermediate tray 36 are led to the vicinity of the transfer region 30 of the photoreceptor 26.

In the transporting path between the paper feed path 34A to 34D and the vicinity o the transfer region 30 of the photoreceptor 26, there are provided resist rollers 35A, 35B, to which the torque of the motor M2 is selectively transmitted through a clutch CLT5 to be described later. In this way, in synchronism with the toner image formed on the surface of the photoreceptor 26, transportation of the copying papers P to the transfer region 30 is controlled.

A discharge tray 40 is disposed on the side wall of the copying machine body 142*a*. A solenoid SOL2 is installed on the discharge tray 40. By exciting the solenoid SOL2 for a predetermined time, the discharge tray 40 is shifted in a direction vertical to the paper surface in FIG. 10. For example, when the solenoid SOL2 is excited to shift the discharge tray 40 in the direction to the nearer side of the paper surface in FIG. 10 by a predetermined distance, when the solenoid SOL2 is excited next time, the discharge tray 40 is shifted in the direction from the surface to the back side of the paper surface in FIG. 10. By such operation of the discharge tray 40, plural copies of copying paper P onto which a set of plural sheets of documents D all copied are sorted, and in this state, they are placed on the discharge tray 40.

In relation to a discharge path 41 for discharging the copying papers P from the fixing device 58 to the discharge tray 40, an inverting path 42 which branches from the discharge path 41 and inverts the copying papers P up side down is provided. The copying papers P after copying from the fixing device 58 are discharged into the discharge tray 40 in the following three modes, corresponding to each of the operation modes of the copying machine 142 set by the operation of the operator to be described later.

(1) To pass the discharge path 41 and discharged into the discharge tray 40.

(2) To be led from the discharge path 41 to the inverting path 42 and stored temporarily in the intermediate tray 36 for copying the other side of the copying paper P. The plural copying papers P stacked on the intermediate tray 36 are led to the vicinity of the transfer region 30 of the photoreceptor 26 one by one, via the paper feed path 37 seriatim from the copying paper P at the bottom by means of a paper feed belt 39. The copying paper P after transfer of the toner image on the other side is led to the fixing device 58, and discharged into the discharge tray 40 through the discharge path 41 after the toner image is heated and fixed.

(3) To be led from the discharge path 41 to the inverting path 42 so as to be inverted up side down, then led again to the discharge path 41 and discharged into the discharge tray 40.

In order to realize these three discharging modes, the inverting path 42 comprises paths 42*a*, 42*b* which branch at two locations in the discharge path 41, a path 42*c* where the paths 42*a*, 42*b* are converged and a path 42*d* branching from the path 42*c* and directing to the intermediate tray 36.

At a branch point of the path 42*a* and the discharge path 41, a direction switching claw 43 is disposed, at a branch point of the paths 42*a*, 42*b* a direction switching claw 44, and at a branch point of the paths 42*c*, 42*d* a direction switching claw 45 are installed respectively, and they are operated by solenoids SOL3, SOL4, SOL5 (not shown) to automatically select the transporting path of the copying papers P responsive to the copying contents desired by the operator.

Near the branch point of the paths 42*a*, 42*b*, rollers 47*a* to 47*c* are disposed, and near, the branch point of the paths 42*c*, 42*d*, rollers 49*a* to 49*c* are arranged for conveying the copying paper P. In the path 42*c* in the vicinity of the branch point of the paths 42*a*, 42*b*, an inverting roller 48 is disposed and rotated in both directions by means of a driving motor M5 so as to invert the conveying direction of the copying paper P, and another inverting roller 50 is installed on the downstream side of the branch point of the paths 42*c*, 42*d* so as to be rotated in both directions by means of a driving motor M6.

Furthermore, a discharge paper sensor S12 is installed near the outlet of the discharge path 41, paper inversion sensors S2, S3 near the inlet of the path 42*a* and in the path 42*c*, and an intermediate tray inlet sensor 34 near the outlet of the path 42*d*. The conveying rollers 42*a* to 46*c* are arranged along the discharge path 41, and a conveying roller 51 is disposed in the path 42*d*. These conveying rollers 46A to 46C are driven by the motor 4 in synchronism with the copy processing portions such as the photoreceptor 26 and the fixing device 58.

In the configuration mentioned above, in the case of discharge mode (1) the path 420 is closed by the switching claw 43, and the copying paper P is discharged along the discharge path 41. In the case of mode (2), the discharge path 41 is closed by the switching claw 43 to lead the copying paper P to the path 42*a* of the inverting path 42, then the path 42*c* is open by the switching claw 44 to lead the copying paper there through, and the conveying direction is inverted by the inverting roller 50. Thereafter, the path 42*d* is open by the switching claw 45 to guide the copying paper P to the intermediate tray 36. In the case of mode (3), after leading the copying paper P into the path 42*c*, the conveying direction is inverted by the inverting roller 48, and the copying paper P is led from the path 42*b* to the discharge path 41 by the switching claw 44.

Though the operating modes of the copying machine 142 change plurally as to be described later, at this time, the exposure means 17 is stopped at positions designated by the reference characters 52, 53 in relation to the first and second reading stations 10, 11, or driven in the direction of the arrow 56 at a uniform speed between a position indicated by the reference character 54 and a position shown by the reference character 55, thereby the document surface is scanned. Sensors S5, S6 are installed respectively in relation to the positions indicated by the reference characters 52, 53 to detect the exposure means 17 and to stop it reliably at the stop position. A similar sensor S7 is also installed in relation to the stop position indicated by the reference character 55 of the exposure means 17 corresponding to one end portion of the placing range of the document related to a document table 11.

Meanwhile, in order to convey the copying paper P in synchronism with the electrostatic latent image formed on the surface of the photoreceptor 26, sensors S8, S9 are disposed respectively in the paper feed path 34A and the transporting path between the paper feed path 34A and the resist rollers 35A, 35B. Moreover, a similar sensor (not shown) is installed in relation to the paper feed paths 34B to 34D. A sensor S10 is arranged in the paper feed path 37 to detect the copying paper P, copied on one side, taken out from the intermediate tray 36 by the paper feed belt 39 and conveyed by the conveying roller 38E. Also, a sensor S18 is disposed for detecting the copying paper P in the intermediate tray 36.

Near the outlet of the copying paper P of the fixing device 58, a sensor S11 is disposed, and in response to its output signal, the operations of the rollers and direction switching claws provided at respective portions in the discharge path 41 and the inverting path 42 are controller.

In the copying machine 142 including the document feeder 140, for example, the following copying operations are effected by multiple recirculations of a flural sheets of documents D.

(A) The operation for obtaining a plurality of sorted simplex copies from simplex documents.

(B) The operation for obtaining a plurality of sorted duplex copies from simplex documents.

(C) the operation for obtaining a plurality of sorted simplex copies from duplex documents.

(D) the operation of obtaining a plurality of sorted duplex copies from duplex documents.

Figure 11:
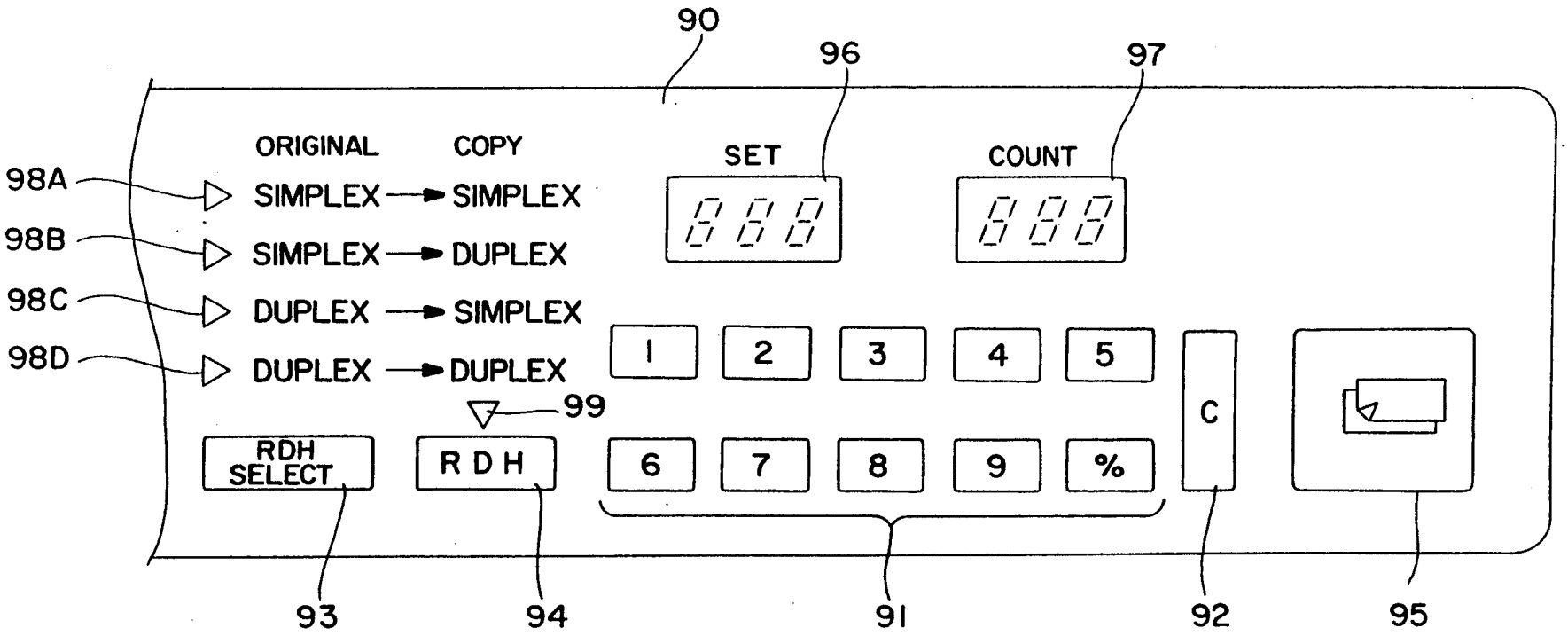
FIG. 11 is a partially plan view of a control panel 90 disposed in the copying machine 142.

FIG. 11 is a partially plan view of a control panel 90 disposed, for example, on the upper surface of the copying machine body 142*a*. The control panel 90 comprises, ten keys 91 for setting the number of copies, a clear key 92, a copying mode select key 93 for setting the copying conditions, an RDH function key 94 for activating/in activating the document feeder 140, a print switch 95 for instructing the start of copying operation, a set number display 96 for indicating the number of copies set by the ten keys 91, a copy number display 97 for indicating the number of sheets copied, copying made displays 98A to 98D for indicating the copying modes selected by the copying mode select key 93, and an RDH function mode display 99. The copying mode displays 98A to 98*d* and the RH function mode display 99 are realized by including such as a light emitting diode which is lit when each of the modes in selected.

The copying mode displays 98A to 98D indicate four copying modes from (A) to (D) above-mentioned, that is, to obtain simplex copies from simplex documents (SIMPLEX→SIMPLEX), to obtain duplex copies from simplex documents 8SIMPLEX→DUPLEX), to obtain simplex copies from duplex documents (DUPLEX→SIMPLEX) and to obtain duplex copies from duplex documents (DUPLEX→DUPLEX).

Whenever the copying mode select key 93 is pressed, the copying modes are selected seriatim from above, and the light emitting diodes of respective displays 98A to 98D are lit. However, when the copying mode select key 93 is pressed while the copying mode display 98D is lit, the copying mode is changed to SIMPLEX→SIMPLEX indicated on the copying mode display 98A.

The document feeder 140 is activated when the RDH function mode display 99 is lit by pressing the RDH function mode key 94, and is inactivated when it is turned off. That is, the operator, when placing a document such as a book on the document table 11 to obtain the copy image on the copying paper P, operates the RDH function key 94 to turn off the RDH function mode display 99. Also, when copying by conveying the document D using the document feeder 140, the RDH function mode display 99 is lit.

When the RDH function is utilized, the operator sets the copying mode in the manner described above by operating the copying mode select key 93. Next, by operating the ten keys 91, the number of copies required is set. At this time, the number of copies set is indicated on the set number display 96.

When the print switch 95 is pressed in succession of operating the ten keys 91, the document feeder 140 and the copying machine body 142*a* cooperate to start the copying operation. At this time, the number of copies finished in shown sequentially on the copy number display 97. When the set number indicated on the copy number display 96 and the numerical value shown on the copy number display 97 are coincided, the operation of the copying machine 142 is stopped and the display of the set number display 96 is reset to "0". At this time, the display on the copy number display 97 is not reset and kept as it is until the print switch 95 is pressed next.

Figure 12:
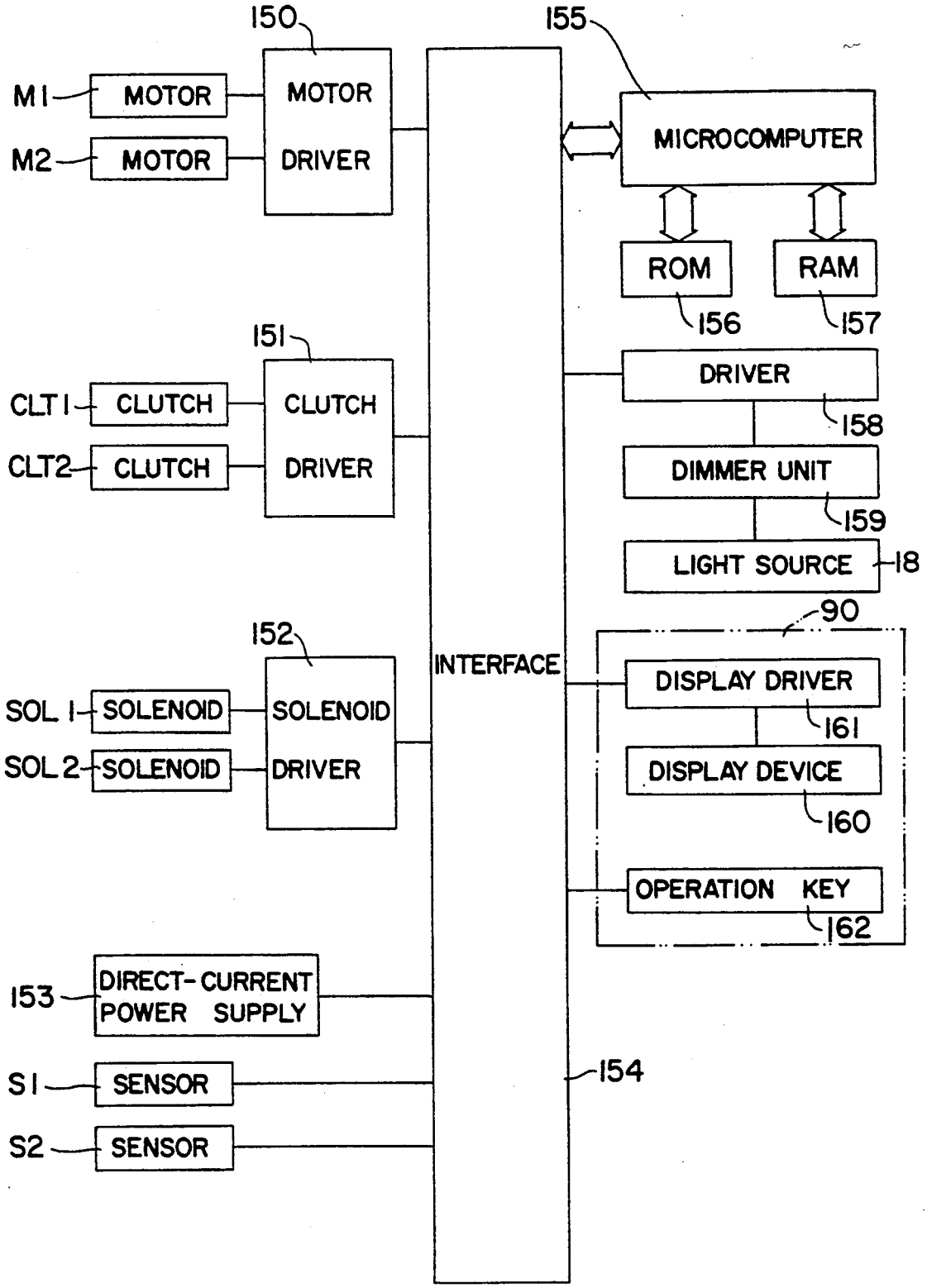
FIG. 12 is a block diagram showing an electrical configuration of the copying machine 142.

FIG. 12 is a block diagram showing an electrical configuration of the copying machine 142. The plurality of motors M1, M2, . . . are connected to a motor driving circuit 150, clutches CLT1, CLT2, . . . to a clutch driving circuit 151, and the plurality of solenoids SOL1, SOL2, . . . to a solenoid driving circuit 152. Control elements used in document transport control, copying paper transport control and copying process control such as the driving circuits 150 to 152 and the power supply 153 are connected to an interface circuit 154. The sensors S1, S2 . . . and further, a processing circuit 155 realized by a microcomputor and the like are connected to the interface circuit 154. Signals from the sensors S1, S2, . . . are given to the processing circuit 155, in which arithmetic processings corresponding to the signals are executed, and drive control signals are given to the driving circuits 150 to 152 via the interface 154.

To the processing circuit 155, an ROM (read-only memory) 156 and an RAM (random access memory) 157 are connected. The processing circuit 155 operates to control according to the control programs stored in the memory 156, using the memory region of the memory 157 as the working region.

The interface circuit 154 is connected to a dimmer unit 159 which energizes the light source 18 of the exposure means 17 via the driving circuit 158, and at the same time, gives display control signals to each of the displays 160 (including displays 96, 97, 98A to 98D, 99) of the control panel 90 via the display driving circuit 161, and is connected to control keys 162 (including keys 91 to 95).

As described above, by providing the document detecting device 110 capable of detecting completion of feeding the documents D reliably on the document feeder 140, reliability of which is improved, thus quality of the copying machine 142 including the document feeder 140 is improved.

Figure 13:
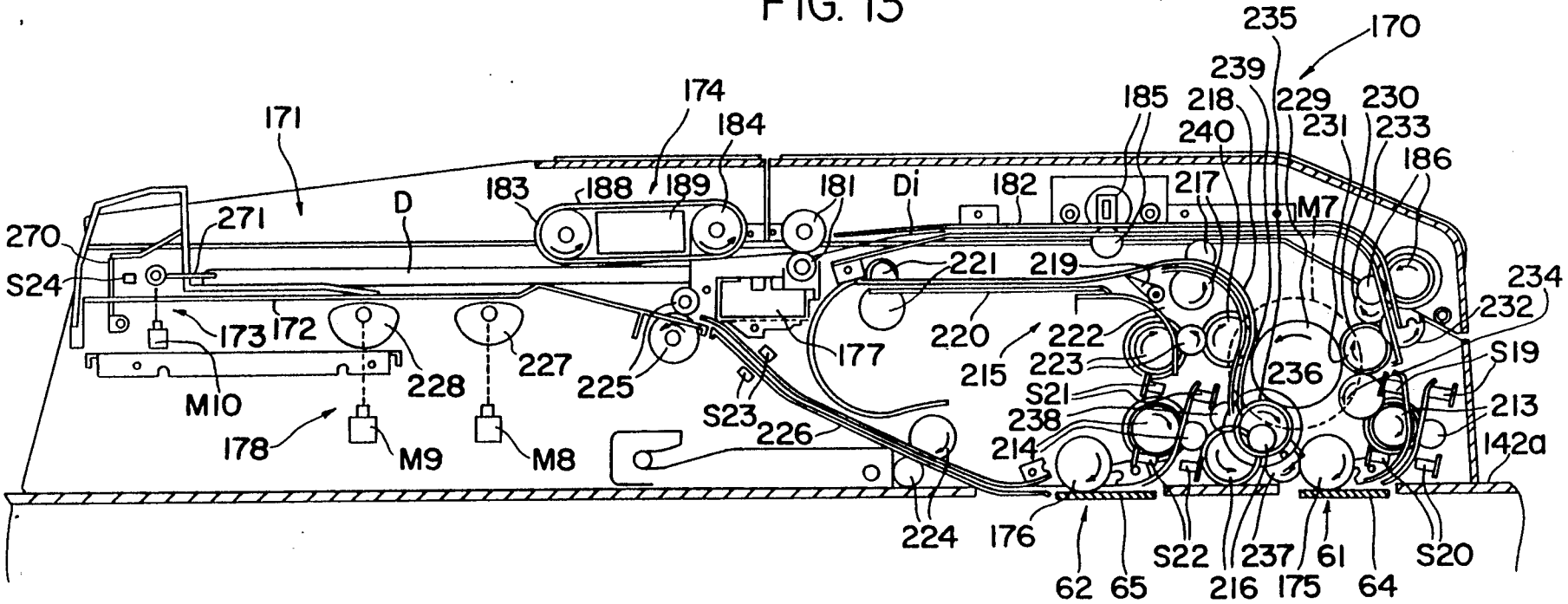
FIG. 13 is a schematic sectional view showing a document feeder 170 of a second embodiment of the invention.
Figure 14:
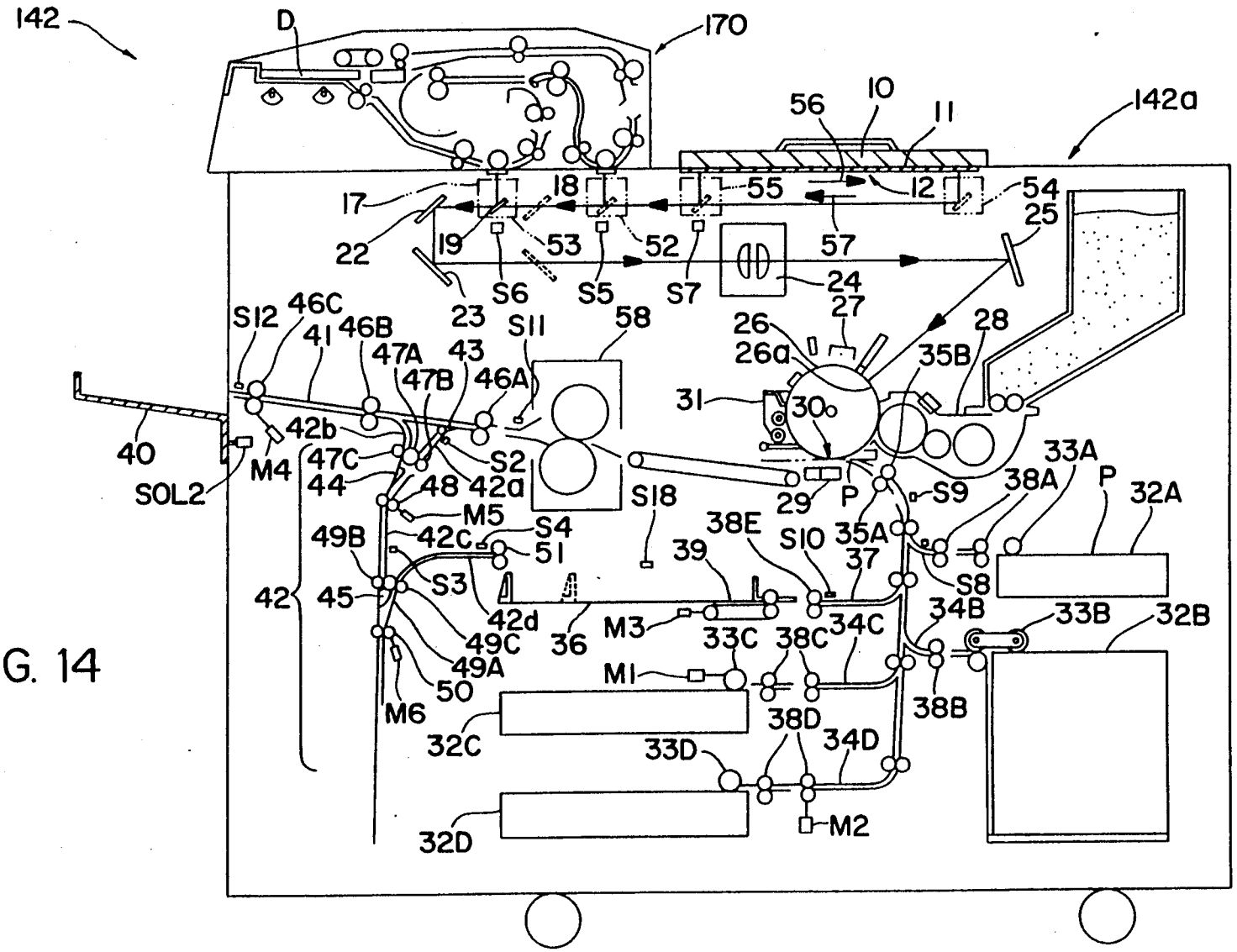
FIG. 14 is a schematic sectional view of the copying machine 142 including the document feeder 170, FIGS. 15 (1–3) are views for explaining the operation of the document feeder 170.

FIG. 13 is a schematic sectional side view of a recirculating document feeder 170 of a second embodiment of the invention, and FIG. 14 is a schematic sectional view showing a basic configuration of a transfer type electrostatic copying machine 142 including the document feeder 170.

On the main body 142*a* of the copying machine 142, the document feeder 170 and a pressing plate 10 are provided. A first transparent plate 64 and a second transparent plate 65 disposed in the document feeder 170 respectively constitutes a first reading station 61 and a second reading station 62. Also, on a pressed surface of the main body 142*a* in relation to the pressing plate 10, a third transparent plate 11 is formed to constitute a third reading station 12. A document image of a book bound is presented at the third reading station 12 for exposure.

Referring to FIG. 13, a plural number of document sheets D of same size arranged in order of page numbers are placed on a placing member 172 of the document feeder 170 such that, the document face of the first page is directed downward. The documents D placed on the placing member 172 are loosened at end faces by air sent from a exhaust duct 177 disposed on its feeding end side, and in this state, the document is taken out seriatim from the one on top by feeding means 174 arranged there about, and fed into a transporting path 182 by a feed roller 181.

The feeding means 174 is constituted by an endless belt 188 installed on rollers 183, 184 and a duct 189 open toward the documents D on the inner circumferential side of the belt 188. The belt 188 is provided with a plurality of scattered suction holes, and a vacuum suction unit, not shown, is connected to the duct 189. Thereby, the document Di is sucked onto the peripheral surface of the belt 188, and in this state, fed to the transporting path 182 by the rotation of the rollers 183, 184. The exhaust duct 177 is connected, for example, to an induced fan and at feeding, flows air against the end face on the downstream side in the feeding direction of the documents D to loose the ends there of so as to prevent multiple feeding.

The transporting path 182 is formed by a pair of guide members and pairs of rollers 185, 186 disposed along the conveying direction, and conveys the documents Di fed between a conveying roller 175 for exposure and the first transparent plate 64. Here, at an outlet of the transporting path 182 on the side of the first transparent plate 64, a pair of first resist rollers 213 are disposed. In relation to the first resist rollers 213, before and behind in the conveying direction, optical sensors 519, S20 respectively consisting of a pair of light emitting element and light receiving element are installed facing the transporting path.

To the roller 186, the rotating power from the motor M7 is transmitted via the clutch CLT1 connected to the rotary shaft of the roller 186, through a gear 229 fined to the driving shaft of the motor M7 and a gear train consisting of gears 230, 231, 232 and 233 meshed with the gear 229. The rotating power of the motor M7 is also transmitted to the rollers 213 via the clutch CLT2 connected to the rotary shaft of the rollers 213, by the gear train consisting of the gears 230, 231 and 234 meshed with the gear 229.

When the front end in the conveying direction of the document Di conveyed by the roller 186 is detected by the sensor S19, the clutch CLT1 provided on the roller 186 is disengaged and the document Di is stopped temporarily. In the copying machine body 142*a*, when the state wherein the copying paper P can be conveyed to a transfer region 30 of the photoreceptor 26 is achieved, the clutches CLT1, CLT2 are engaged, thereby the document Di is conveyed between the conveying roller 13 for exposure and the first transparent plate 64. At this time, the front end in the conveying direction of the document Di is detected by the sensor S20, and according to this timing, the conveying operation of the copying paper P to the transfer region 30 is controlled.

By conveying the document Di which is pressed against the first transparent plate 64 by the conveying roller 175 for exposure, an document image of its one surface is presented at the first reading station 61. Next, the document Di is conveyed between the conveying roller 176 for exposure and the second transparent plate 65 by a second resist roller 214, after its conveying direction being inverted by inverting means 215.

In the inverting means 215, the document Di from the first reading station 61 is led into a transporting path 220 from a transporting path 218 formed by a pair of guide members and pairs of conveying rollers 216, 217 disposed along the conveying direction via a switching claw 219. In the transporting path 220, an inverting roller 221 which is rotable in both directions is installed. The document Di conveyed to the transporting path 220 is led into a transporting path 222 by inversion of the rotating direction of the inverting roller 221 and the switching claw 219, and conveyed to the second resist roller 214 by a conveying roller 223.

To the conveying roller 223 and the second resist roller 214, clutches CLT3, CLT4 are coupled respectively. In relation to the second resist roller 214, before and behind in the conveying direction, a pair of optical sensors S21, S22 are installed facing the conveying path 222. In response to outputs from the sensors S21, S22, the operation of the clutches CLT3, CLT4 is controlled.

Here, to the conveying roller 176 for exposure, the rotating power of the motor M7 is given via a gear train consisting of gears 235, 236 and 237 meshed with the gear 229. To the conveying rollers 216, 217 connected through an endless belt, the rotating power of the motor M7 is also transmitted via the gears 229, 235, 236 and 238. The rotating power applied to the conveying roller 216 is also transmitted to the second resist roller 214 and the conveying roller 176 for exposure connected through an endless belt and the like. Mean while, the motor M7 transmits the rotating power to the conveying roller 223 from the gear 229 via idle gears 240, 239.

By the conveying rollers 216, 217, 223 and the second resist roller 214 driven by the aforesaid configuration, the document Di is conveyed to the second reading station 62, and conveyed as being pressed against the second transparent plate 65 by the conveying roller 176 for exposure. Since the conveying direction of the document Di conveyed in the second reading station 62 is inverted in the inverting means 21 beforehand, a document image of the other surface is presented at the second reading station 62.

The document Di whose images on both surfaces have been presented is guided through a transporting path 226 by a pair of guide members and pairs of conveying rollers 224, 225 provided along the conveying direction, and conveyed to a placing member 172. Under the placing member 172, halfmoon rollers 227, 228 are disposed along the conveying direction and to respective rotary shafts of the halfmoon rollers 227, 228, the rotating power from motors M8, M9 realized by such as a stepping motor is given.

The document Di thus conveyed is received at the bottom of the documents D placed on the placing member 172 by the operation of the halfmoon rollers 227, 228 to be described later. Receiving and conveying means 171 of the document feeder 170 is constituted by the halfmoon rollers 227, 228, and driving means 178 of the receiving and conveying means 171 is constituted by the motors M7, M8.

Near the conveying roller 225 in the transporting path 226, an optical sensor S23 is installed facing the transporting path. According to the output of the sensor S23, the operation of the halfmoon rollers 227, 228 is controlled. On the downstream side in the receiving direction of the document in the placing member 172 for detecting one circulation of the feeding operation of the documents D placed thereon, a one-circulation detecting device 173 is provided. This one-circulation detecting device 173 detects one circulation of document feeding by dividing the document which is still not fed and the document which have been returned, and also detects the presence of the stacked documents D.

The one-circulation detecting device 173 is constituted by for example, a pair of pressing members 270, 271 and a sensor S24 for detecting its angular displacement. The lower pressing member 271 contacts to the underside of the documents D placed on the placing member 174 by the rotating power from the motor M10, and further, urges the documents D upward by urging means such as a spring, not shown, installed on the rotary shaft. The upper pressing member 270 contacts to the end portion on the upstream side in the feeding direction of the documents D urged upward by the lower pressing member 271 from the upper side.

In this way, the documents D on the placing member 172 are clamped by a pair of pressing members 270, 271, and urged upward in the stacking direction at the end portion of the upstream side of its feeding direction. The sensor S24 is realized by, for example, a pair of light emitting element and light receiving element, and detects the state wherein a light path formed therebetween is interrupted by angular displacement of the lower pressing member 271, thereby one circulation related to feeding and receiving of the documents D is detected.

Figure 15:
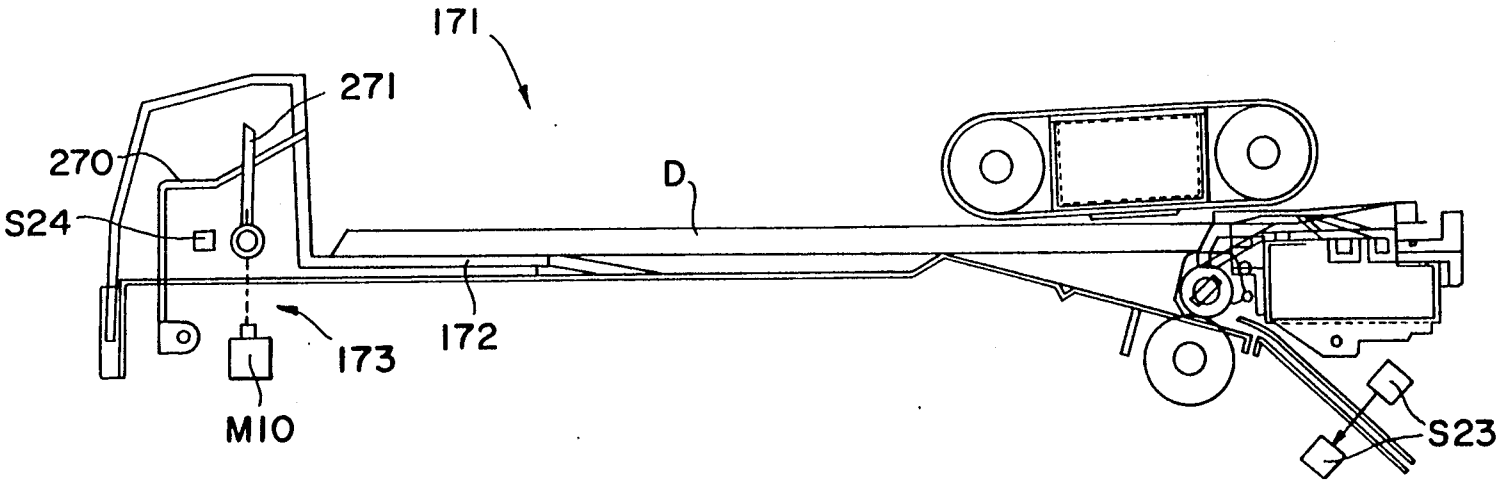
Figure 15:
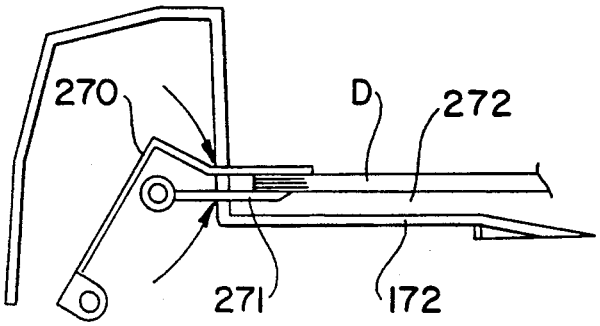
Figure 15:
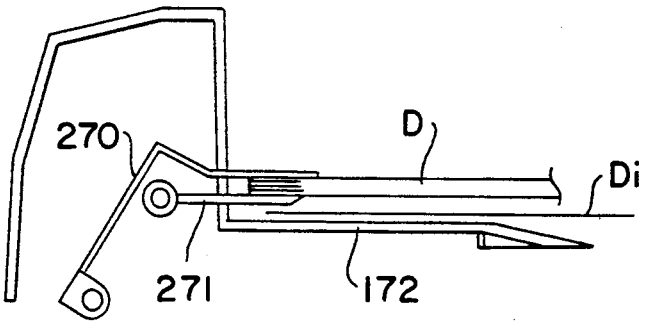

FIG. 15 is a view for explaining the operation of the receiving and conveying means 171 of the document feeder 170. A pair of pressing members 270, 271 are at positions shown in FIG. 15(1), when the documents D to be fed are not placed on the placing member 172 by the operator.

When the operator places the documents D to be copied on the placing member 172 of the document feeder 170 for coping by using the document feeder 170, and operates the print switch 95 and so on of the control panel 90 to start copying, first, the upper pressing member 270 displaces angularly clockwise and contacts to the documents D to regularity the upward displacement of the documents. Next, the lower pressing member 271 displaces angularly counterclock-wise and contacts to the underside of the documents D to urge it upward at the end portion on the upstream side in the feeding direction of the documents D. Thereby, between the documents D urged upward at the end portion on the upstream side in the feeding direction and the placing member 172, a space 272 is formed (refer to FIG. 15(2)).

In the state shown in FIG. 15(2), the document Di, which is received after presenting its images at the reading stations 61, 62, is returned easily to the bottom of the documents D stacked on the placing member 172 through the space 272 (refer to FIG. 15(3)).

Also, in the state shown in FIG. 15(2), when the documents D are fed seriatim from the one on top by the feeding means 174, and no document is interposed between the upper and lower pressing members 270, 271, the lower pressing member 271 displaces angularly counterclockwise and this state is detected by the sensor S24. In this way, one circulation of the documents D placed on the placing member 172 in the document feeder 170 can be detected. At this time in the document feeder 170, since the documents D to be fed are clamped by the upper and lower pressing members 270, 271, even during the feeding operation of the documents up-and-down movements of the documents D urged upward at the end portion on the upstream side in the feeding direction on the placing member 172 are suppressed, and malfunction of detecting one circulation can be prevented.

When the copying operation using the document feeder 170 is completed, the upper and lower pressing members 270, 271 are restored to the initial positions shown in FIG. 15(1), so as to facilitate processings such as removing the documents D whose one circulation related to feeding and returning is completed.

Figure 16:
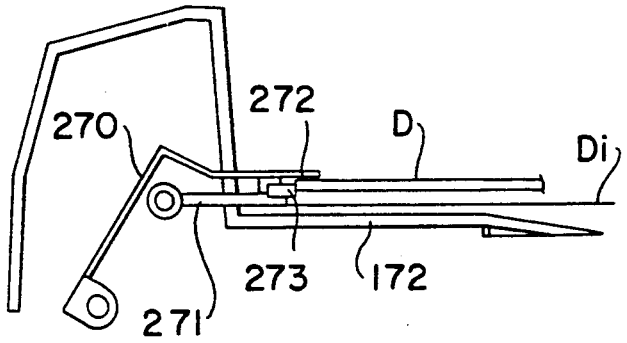
FIG. 16 to FIG. 18 are views for explaining the configuration and operation of another embodiment of the invention.
Figure 17:
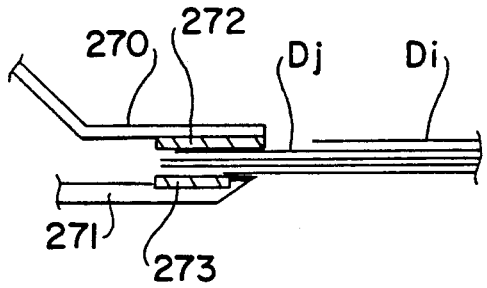
Figure 18:
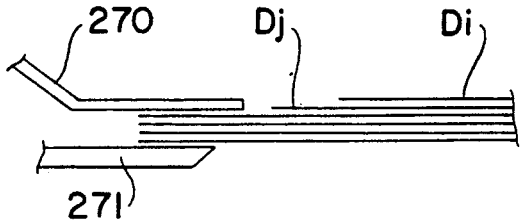

FIG. 16 to FIG. 18 are views for explaining the configuration and operation of another embodiment of the invention. In this embodiment, in addition to the configuration shown in FIG. 13 aforementioned, friction pads 272, 273 are provided respective, on one surface of the pressing members 270, 271 contacting to the documents D for preventing multiple feeding at document feeding. As the friction pads 272, 273, for example, an artificial leather on the like whose friction factor with the document D is slightly larger than that between the documents is selected.

As shown in FIG. 17, by providing the friction pads 272, 273 aforementioned on the upper and lower pressing members 270, 271, the documents Di, Dj are not fed multiply at feeding. That is, as shown in FIG. 18 in which the friction pads 272, 273 are not provided, when the document Di on top of the documents D is detached from the upper and lower pressing members 270, 271 and fed by the feeding means 174, by the friction force exerted between the document Di and the document Dj which is in contact with the document Di and to be fed next, the document Dj tends to move also and detaches from the upper and lower pressing members 270, 271. In such a situation, a predetermined relative position between the feeding means 174 may chift when the document Dj is to be fed, thereby multiple feeding may occur or improper feeding such as jamming of papers takes place.

In this embodiment, however, movement of the document Dj at feeding of the document Di is suppressed by the friction pads 272, 273, accordingly, the multiple feeding and improper feeding can be prevented. Also, since the aforesaid multiple feeding of the documents can be prevented reliably even when the number of document sheets between the upper and lower pressing members 270, 271 has decreased, the documents D to be fed can be fed seriatim from the top one by one as being clamped by the upper and lower pressing members 270, 171 till the last sheet. Thus, malfunction of the one circulation detecting device 173 is prevented and operation reliability of the document feeder 170 is improved.

FIG. 19 to FIG. 21 are views for explaining the configuration and operation of still another embodiment of the invention. In this embodiment, on a surface of, at least, one of the upper and lower pressing members 270, 271 (the upper pressing member 270 in FIG. 19) contacting to the documents D to be fed, a triangular-prism-shaped edge uniforming member 274 is provided.

The edge uniforming member 274 contacts its tilted surface 275 to the end face on the upstream side in the feeding direction, when the upper and lower pressing members 270, 271 clamp the documents D prior to feeding of the documents D (refer to FIG. 15(2)). Thereby, the end face on the downstream side in the feeding direction of the documents D is adjusted to a shape protruding toward the downstream side in the feeding direction, corresponding to the shape of the tilted surface 275 of the edge uniforming member 274 as going upward in the tacking direction as shown in FIG. 20.

Thereby, efficiency of loosening the end face on the downstream side in the feeding direction of the documents D, when air 177*a* is blown from the exhaust duct 177, is improved remarkably as compared with the case wherein the end face is uneven due to lack of the edge uniforming member 274 as shown in FIG. 31. Thereby, the document Di is sucked and attracted upward by the feeding means 174 and conveyed one by one reliably. Accordingly, multiplex feeding of the documents by the feeding means 174 is prevented and reliability of the feeding operation of the document feeder 170 is improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claims is:

1. A recirculating sheet feeder which feed sheets from stacked sheets seriatim from the one on top of the stacked sheets and returns sheets to the bottom of the stacked sheets comprising:

a placing member for placing the stacked sheets;

means for feeding the sheets stacked, on the placing member;

a detecting protrusion for contacting the lower surface of the stacked sheets on the placing member, and disposed for rotation about an axis extending along the placing member;

a spring for urging the detecting protrusion in an upward direction;

means for detecting displacement of the detecting protrusion when a sheet is not present on the placing member;

a pressing member for hindering the upward displacement of the sheets stacked on the placing member and contacting the sheets when the detecting protrusion moves said sheets in contact with said pressing member; and means for rotating the detecting protrusion.

2. The recirculating sheet feeder as claimed in claim 1, wherein said means for rotating the detection protrusion, rotates the detection protrusion 360°.

3. The recirculating sheet feeder as claimed in claim 1, wherein said pressing member has at least one substantially flat surface for contacting a sheet of the stacked sheets.

4. The recirculating sheet feeder as claimed in claim 3, wherein said pressing member is of U shape providing an opening, so that when said detection protrusion has completed urging a final sheet of a stack in the upward direction, the projection protrusion can pass through the opening so as to urge another stack of sheets in the upward direction.

5. A recirculating sheet feeder including a placing member for placing stacked sheets, and for feeding the sheet on top of the stacked sheets on the placing member and returning the sheets to the bottom of the stacked sheets comprising;

a detecting protrusion for contacting the bottom of the sheets on the placing member, and for urging the stack in an upward direction;

pressing means disposed above the sheets for regulating upward displacement of the sheets by the detecting protrusion;

means for conveying the sheets fed to the underside of the detecting protrusion; and driving means for moving the detecting protrusion to the bottom of the sheets, which have been conveyed to the underside of the detection protrusion, after the last sheet in a stack moved in the upward direction has been fed.

6. A recirculating sheet feeder as claimed in claim 5 wherein a contact between the detecting protrusion and the sheet is movable above a contact between the pressing member and the sheet, and includes detecting means for detecting one circulation of the sheet by the operation of the detecting protrusion after it has moved above the contact between the pressing member and the sheet.

7. A recirculating sheet feeder as claimed in claim 5 wherein the pressing member is disposed so as to be able to open and move upward when the sheets are placed on the placing member.

8. A recirculating sheet feeder as claimed in claim 5 further comprising moving means for moving the pressing member when the sheets are placed on the placing member, so that the stack of sheets can be placed on placing member without interference of the pressing member.

9. A recirculating sheet feeder including a placing member for placing sheets contained in stack so that, a sheet on top of the sheets stacked on the placing member can be fed and returned to the bottom of the stacked sheets, comprising;

a detecting protrusion member for contacting the bottom of the sheets on the placing member, and urging them in an upward direction, and a contacting member formed with a contacting surface which contacts to the end face, on an upstream side in the feeding direction, of the stacked sheets, when the sheets are urged upward by the detecting protrusion.

10. The recirculating feeder as claimed in claim 9, wherein said protrusion member and contacting member maintain said stack of sheets in a position above the placing member, so that a space is provided below the protrusion member for receiving another stack of sheets.

11. The recirculating sheet feeder as claimed in claim 9, wherein when there are no sheets on the placing member the contacting member is located below an upper portion of the detection protrusion member.

12. The recirculating feeder as claimed in claim 9, further including friction means located on said contacting member and detection protrusion member.

13. The recirculating feeder as claimed in claim 9, further including means for rotating said projection protrusion member in an upper direction.

14. The recirculating feeder as claimed in claim 13, further including means for rotating said contacting member in a lower direction.

15. The recirculating feeder as claimed in claim 9, further including a shaped projection that has a tilted surface located on the contacting member, so that the tilted surface contacts an end face of the documents in the feeding direction.

16. The recirculating feeder as claimed in claim 9, further including a shaped projection that has a tilted surface located on the protrusion member, so that the tilted surface contacts an end face of the documents in the feeding direction.

17. The recirculating feeder as claimed in claim 9, wherein said protrusion member includes a friction pad.

18. The recirculating feeder as claimed in claim 17, wherein said contacting member includes a friction pad, and the friction pads having a friction factor which is greater than the friction factor between the documents, so that a multiplicity of documents are not fed together.

* * * * *